US011033071B2

(12) United States Patent
Farris et al.

(10) Patent No.: US 11,033,071 B2
(45) Date of Patent: Jun. 15, 2021

(54) SOLE STRUCTURE WITH PROGRESSIVELY ADAPTIVE STIFFNESS

(71) Applicant: NIKE, Inc., Beaverton, OR (US)

(72) Inventors: Bryan N. Farris, North Plains, OR (US); Austin Orand, Portland, OR (US); Aaron B. Weast, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 102 days.

(21) Appl. No.: 16/577,615

(22) Filed: Sep. 20, 2019

(65) Prior Publication Data

US 2020/0008520 A1 Jan. 9, 2020

Related U.S. Application Data

(63) Continuation of application No. 15/814,778, filed on Nov. 16, 2017, now Pat. No. 10,448,702.

(60) Provisional application No. 62/424,898, filed on Nov. 21, 2016.

(51) Int. Cl.

| | |
|---|---|
| ***A43B 13/14*** | (2006.01) |
| ***A43B 3/00*** | (2006.01) |
| ***A43B 3/24*** | (2006.01) |
| ***A43B 7/14*** | (2006.01) |
| ***A43D 999/00*** | (2006.01) |
| ***A43B 13/18*** | (2006.01) |
| *A43B 13/02* | (2006.01) |
| *A43B 13/12* | (2006.01) |
| *A43B 5/02* | (2006.01) |

(52) U.S. Cl.

CPC ..... *A43B 13/141* (2013.01); *A43B 3/0036* (2013.01); *A43B 3/246* (2013.01); *A43B 7/1465* (2013.01); *A43B 13/181* (2013.01); *A43D 999/00* (2013.01); *A43B 5/02* (2013.01); *A43B 13/02* (2013.01); *A43B 13/12* (2013.01)

(58) Field of Classification Search

CPC ..... A43B 13/141; A43B 3/26; A43B 13/18; A43B 13/181; A43D 999/00

USPC ..... 36/97, 102, 103, 25 R, 31; 12/146 B, 12/146 S

See application file for complete search history.

(56) References Cited

U.S. PATENT DOCUMENTS

| | | | | |
|---|---|---|---|---|
| 5,517,769 | A * | 5/1996 | Zhao | A43B 13/18 36/27 |
| 5,537,762 | A | 7/1996 | Walters | |
| 6,305,102 | B1 | 10/2001 | Doyle | |
| 7,917,981 | B1 | 4/2011 | Lakic | |
| 10,448,702 | B2 * | 10/2019 | Farris | A43B 7/1465 |
| 2002/0035794 | A1 | 3/2002 | Doyle | |

(Continued)

*Primary Examiner* — Marie D Bays

(74) *Attorney, Agent, or Firm* — Quinn IP Law

(57) ABSTRACT

A sole structure for an article of footwear comprises a sole plate including a foot support portion with a foot-facing surface and a ground-facing surface. An opening extends through the foot support portion from the foot-facing surface to the ground-facing surface. The sole plate includes a bridge portion underlying the opening and secured to the foot support portion fore and aft of the opening. The sole structure includes a piston that has a body and a support arm extending transversely from the body. The body extends through the opening. The support arm is supported on the bridge portion, trapped below the ground-facing surface by the foot support portion, and extends under the ground-facing surface at medial and lateral sides of the opening.

19 Claims, 11 Drawing Sheets

(56) References Cited

U.S. PATENT DOCUMENTS

| | | | | |
|---|---|---|---|---|
| 2003/0188460 | A1 | 10/2003 | Dubner | |
| 2004/0064974 | A1 | 4/2004 | Schuster | |
| 2007/0094890 | A1 | 5/2007 | Cho et al. | |
| 2007/0209231 | A1 | 9/2007 | Wu | |
| 2010/0242303 | A1 | 9/2010 | Callahan et al. | |
| 2011/0067264 | A1 | 3/2011 | Doyle | |
| 2011/0107618 | A1 | 5/2011 | Kim | |
| 2012/0073161 | A1 | 3/2012 | Doyle | |
| 2013/0326912 | A1 | 12/2013 | Lindsay et al. | |
| 2015/0305436 | A1 | 10/2015 | Doyle | |
| 2016/0256349 | A1 | 9/2016 | Mayer et al. | |
| 2017/0340055 | A1* | 11/2017 | Schneider | A43B 13/141 |
| 2017/0340056 | A1* | 11/2017 | Bunnell | A43B 13/16 |
| 2018/0140043 | A1* | 5/2018 | Farris | A43B 3/0036 |

* cited by examiner

SOLE STRUCTURE WITH PROGRESSIVELY ADAPTIVE STIFFNESS

CROSS-REFERENCE TO RELATED APPLICATION

This application is a continuation of U.S. patent application Ser. No. 15/814,778, filed Nov. 16, 2017, which claims the benefit of priority to U.S. Provisional Application No. 62/424,898, filed Nov. 21, 2016, and both of which are hereby incorporated by reference in their entirety.

TECHNICAL FIELD

The present teachings generally include a sole structure for an article of footwear.

BACKGROUND

Footwear typically includes a sole structure configured to be located under a wearer's foot to space the foot away from the ground. Sole structures in athletic footwear are typically configured to provide cushioning, motion control, and/or resiliency.

DESCRIPTION

Figure 1:
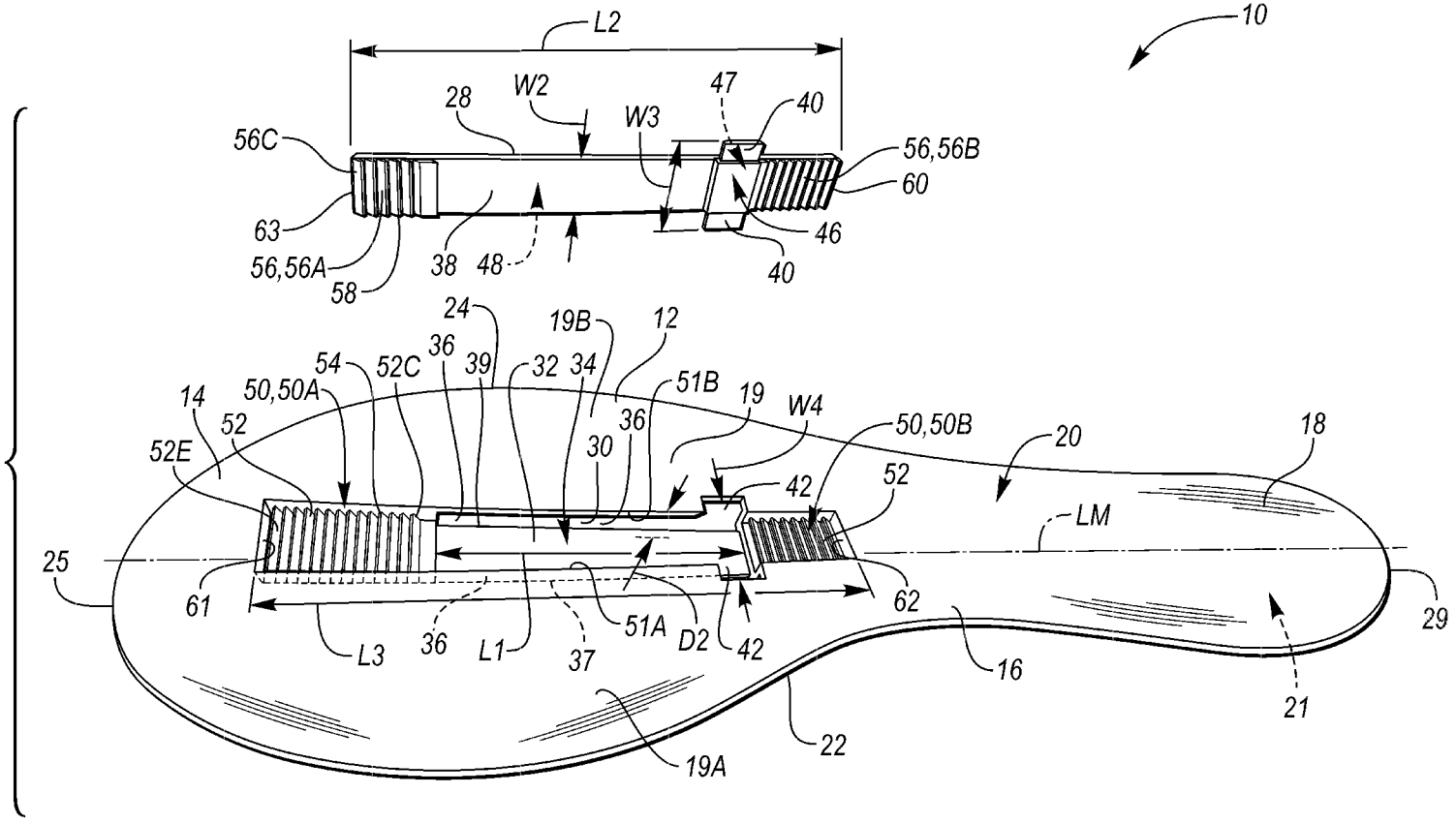
FIG. 1 is a schematic illustration in exploded perspective view of an embodiment of a sole structure for an article of footwear with a piston inverted.

A sole structure for an article of footwear has a sole plate and a piston that is moved by dorsiflexion relative to the sole plate, causing the stiffness of the sole structure to change as the piston progresses along the sole plate. The dorsiflexion and hence the change in stiffness is entirely human-powered (i.e., powered entirely by the movement of the wearer), and is referred to as a progressively adaptive stiffness. The progression of the piston and the corresponding change in stiffness can be tuned for a specific number of steps (i.e., number of dorsiflexions) that an athlete is expected to take in an athletic event of a given distance, and during different portions of the event.

The sole plate and piston can be configured so that the change in stiffness under bending along a longitudinal axis of the sole plate can increase and/or decrease with successive dorsiflexion, and/or the change in stiffness under bending in the lateral direction can increase and/or decrease. The progressive adaptive stiffness can thus be correlated with a particular race, including a race around a curved track, where increasing stiffness is desired. In this and other embodiments described herein in which the piston progresses along teeth or other protrusions of the sole plate, the number of teeth or protrusions can be correlated with a number of steps a person wearing the sole structure is expected to take when utilizing the sole structure for a predetermined event, such as participating in a race of a particular distance and/or on a track or course of a known route. In this manner, the change in bending stiffness can aid the wearer by varying the cushioning characteristic in a manner advantageous to the wearer, such as by increasing or decreasing longitudinal or transverse bending stiffness in correlation with various stages of the race. The expected number of steps can be specific to a particular athlete, or may represent a population average for the expected population of wearers.

For example, the sole structure may be configured to progressively increase in bending stiffness in the longitudinal direction (such as along a longitudinal midline of the sole structure) after a predetermined number of steps and corresponding number of dorsiflexions expected toward the end of a race of a known distance. The increased stiffness may help to maintain proper form when the foot is fatigued. The sole structure may be configured to progressively increase in stiffness after a predetermined number of steps and corresponding number of dorsiflexions expected when a runner is on a curved portion of a track or course. At the curved portion, increased bending stiffness in a lateral direction (i.e., perpendicular to the longitudinal midline) may be desired to support the side of the foot nearer the outside of the curve, such as at the lateral side of the sole structure on the right foot (assuming the race progresses in a counter-clockwise direction around the curved track). The sole structure may be configured to progressively increase and decrease in stiffness in the longitudinal and transverse directions multiple times over the course of progression of the piston along the sole plate. For example, the transverse stiffness may increase along two curves of an oval track, and decrease on the straightaway between the curves.

In an embodiment, the sole plate has a foot support portion with a foot-facing surface and a ground-facing surface. An opening in the sole plate extends through the foot support portion from the foot-facing surface to the ground-facing surface. The sole plate has a bridge portion underlying the opening and secured to the foot support portion fore and aft of the opening. The piston has a body and a support arm extending transversely from the body. The body extends through the opening. The support arm is supported on the bridge portion, and is trapped below the ground-facing surface by the foot support portion, extending under the ground-facing surface at medial and lateral sides of the opening.

With the support arm above the bridge portion and below the ground-facing surface, the distance of the bridge portion from a neutral axis in the sole plate and the resulting bending stiffness of the sole structure are dependent on the progressing position of the piston. The piston is moved relative to the sole plate by dorsiflexion of the sole plate, with the bridge portion in tension, the foot support portion in compression, and the support arm separating the bridge portion and the foot support portion.

In some embodiments, the sole plate has a guide track, and the body of the piston has an engagement feature that engages with the guide track, ratcheting the piston incrementally along the guide track with repetitive dorsiflexion of the sole plate. The bending stiffness of the sole structure varies with a position of the piston along the guide track.

In some embodiments, the guide track has teeth, and the engagement feature of the piston is at least one tooth that engages with the teeth of the guide track. The guide track may have different segments, and the teeth of the different segments may angle in different directions to guide the piston along a segmented path. For example, in one section, the teeth may angle forward, in the next section, the teeth may angle in a transverse direction, and then in the next section, the teeth may angle rearward.

The teeth of the guide track may have a varied spacing. Widely spaced teeth (i.e., teeth with a large pitch) will advance the piston a greater distance along the sole plate with each dorsiflexion than closely spaced teeth (i.e., teeth with a small pitch). The piston may be configured to move along teeth of different spacings. For example, in one embodiment, the piston body includes a rear car and a front car. The teeth of the guide track have a first spacing at a first portion of the guide track. The teeth of the guide track have a second spacing less than the first spacing at second portion of the guide track. The sole plate has an obstruction that blocks ratcheting of the rear car along the guide track at a predetermined position between a start position and a final position of the piston body. The rear car abuts the front car between the start position and the predetermined position such that the front car is moved by the rear car as the rear car is ratcheted along the guide track from the start position to the predetermined position by repetitive dorsiflexion of the sole structure. The front car continues to move relative to the sole plate by repetitive dorsiflexion of the sole structure after the rear car is blocked, by ratcheting along the guide track free of the obstruction from the predetermined position to the final position.

In an embodiment, the teeth of the guide track are split in two transversely-spaced sets at the first portion of the guide track. A split tooth of the rear car engages the transversely-spaced set of teeth. A tooth of the front car extends from the front car between the transversely-spaced sets and is not engaged with the guide track when the split-tooth of the rear car progresses along the first portion of the guide track, but engages the teeth of the second portion of the guide track when the front car progresses without the rear car.

The guide track may be configured to advance the piston in a linear or nonlinear path relative to the sole plate. For example, the guide track may advance the piston along a curved track, or a track with multiple linear segments. In an embodiment, the guide track is curved toward a lateral side of the sole plate such that bending stiffness of the sole plate under bending in a transverse direction increases as the piston is ratcheted along the guide track.

In another embodiment the guide track has different segments that cause the piston to move in different directions relative to the sole plate as the piston progresses along the segments. For example, in an embodiment, the guide track has a first segment with a first series of teeth, and a second segment with a second series of teeth. The second segment is oriented at a first angle with respect to the first segment. A first post extends from the plate between the first segment and the second segment. The first post is positioned on the sole plate so that it contacts the at least one tooth of the piston as the piston is ratcheted along the sole plate. The at least one tooth of the piston is pivotable, and pivots by the first angle when it is in contact with the at least one tooth of the piston, thereby orienting the at least one tooth for subsequent engagement with the second series of teeth. For example, the first series of teeth may progress in a longitudinal direction along the sole plate, and the second series of teeth may progress in a transverse direction along the sole plate. Accordingly, when the at least one tooth is pivoted to engage with the second series of teeth, the piston progresses transversely along the sole plate. The second segment may be relatively short, and a second post may extend from the sole plate between the second segment and a third segment of the guide track that has a third series of teeth. The third segment is oriented at a second angle with respect to the second segment. The second post contacts the at least one tooth of the piston, pivoting the at least one tooth by the second angle after the at least one tooth progresses along the second series of teeth. The at least one tooth is thus oriented to engage with the third series of teeth, which progress in an opposite direction as the first series of teeth so that the piston is ratcheted in the opposite direction along the third series of teeth, having the opposite effect on changing bending stiffness than progression along the first series of teeth. For example, the first series of teeth may progress in a forward direction along the sole plate and the third series of teeth may progress in a rearward direction along the sole plate so that the piston is ratcheted forward along the first series of teeth, with the position of the arm therefore increasing bending stiffness. The piston and is ratcheted rearward along the third series of teeth, with the position of the arm thereby decreasing bending stiffness.

In some embodiments, the teeth of the guide track and the at least one tooth of the piston extend transversely relative to the sole plate. For example, each tooth of the guide track extends from a base to a tip in a transverse direction relative to the sole plate, and the at least one tooth of the piston extends from a base to a tip in an opposite transverse direction to engage the teeth of the guide track.

The piston and the guide track are not limited to embodiments having teeth that engage with one another. For example, in an embodiment, the guide track includes a first set of directional fibers, and the engagement feature of the piston is a second set of directional fibers that engages with the first set of directional fibers.

A sole structure for an article of footwear comprises a sole plate. The sole plate includes a foot-facing surface and a ground-facing surface. The sole plate has a compressive portion above a neutral axis, and a tensile portion below the neutral axis. The sole plate includes a guide track in the foot-facing surface. The guide track includes a series of protrusions. The sole structure includes a piston that has a body disposed above the tensile portion, and a support arm extending from the body, resting on the tensile portion, and disposed below the compressive portion and against the ground-facing surface. The piston includes at least one protrusion engaged with the series of protrusions of the guide track and ratcheting the piston along the guide track as the piston translates relative to the sole plate in response to dorsiflexion of the sole structure. In an embodiment, the sole plate has an opening, the body of the piston extends through the opening, and the support arm extends across the opening. In an embodiment, the bending stiffness of the sole structure varies with a position of the piston along the guide track.

In an embodiment, the series of protrusions is a first set of directional fibers, and the at least one protrusion of the piston is a second set of directional fibers engaged with the first set of directional fibers. In another embodiment, the series of protrusions is a set of teeth, and the at least one protrusion of the piston is a tooth that engages with the set of teeth.

The above features and advantages and other features and advantages of the present teachings are readily apparent from the following detailed description of the modes for carrying out the present teachings when taken in connection with the accompanying drawings.

"A", "an", "the", "at least one", and "one or more" are used interchangeably to indicate that at least one of the items is present. A plurality of such items may be present unless the context clearly indicates otherwise. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. In addition, a disclosure of a range is to be understood as specifically disclosing all values and further divided ranges within the range. All references referred to are incorporated herein in their entirety.

The terms "comprising", "including", and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. The term "any of" is understood to include any possible combination of referenced claims of the appended claims, including "any one of" the referenced claims.

Those having ordinary skill in the art will recognize that terms such as "above", "below", "upward", "downward", "top", "bottom", etc., may be used descriptively relative to the figures, without representing limitations on the scope of the invention, as defined by the claims.

Figure 4A:
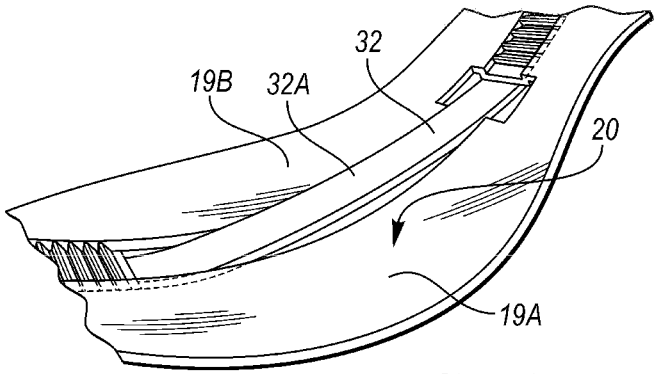
FIG. 4A is a schematic illustration in fragmentary perspective view of the sole structure of FIG. 1 in dorsiflexion with the piston removed.
Figure 4B:
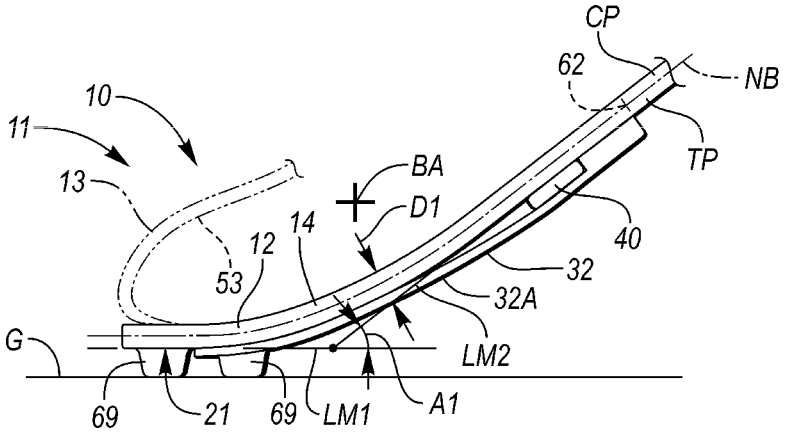
FIG. 4B is a schematic illustration in cross-sectional fragmentary side view of the sole structure of FIG. 1 in dorsiflexion with the piston in a first position.
Figure 4C:
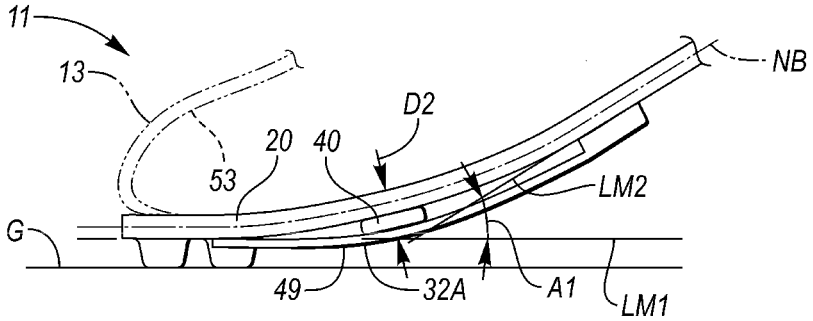
FIG. 4C is a schematic illustration in cross-sectional fragmentary side view of the sole structure of FIG. 1 is dorsiflexion with the piston in a second position forward of the first position.

Referring to the drawings, wherein like reference numbers refer to like components throughout the views, FIG. 1 shows a sole structure 10 for an article of footwear 11 shown in FIGS. 4B-4C. The sole structure 10 has a resistance to flexion that varies with repeated dorsiflexion of the forefoot region 14 of the sole structure 10 (i.e., flexing of the forefoot region 14 in a longitudinal direction as discussed herein). As further explained herein, due to a piston 28 that moves relative to a sole plate 12 in response to dorsiflexion of the sole structure 10, the sole structure 10 provides a varying bending stiffness when flexed in a longitudinal direction. More particularly, because the piston 28 has a body 38 supported on a bridge portion 32 of the sole plate 12, and a support arm 40 extending from the body 38 underneath a ground-facing surface 21 of the sole plate 12, the sole structure 10 has a bending stiffness that varies with successive dorsiflexion of the sole structure 10. The bending stiffness is tuned by the selection of various structural parameters discussed herein. As used herein, "bending stiffness" may be used interchangeably with "bend stiffness".

Figure 2:
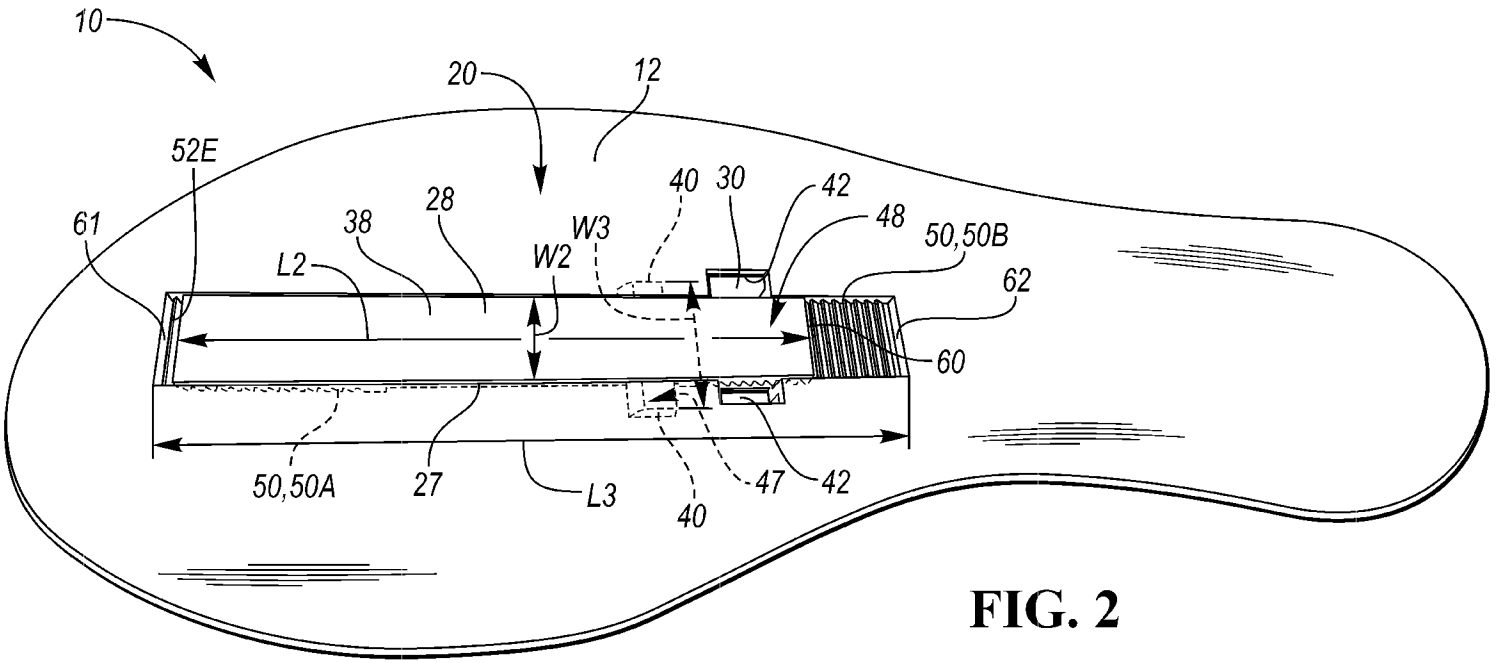
FIG. 2 is a schematic illustration in perspective view of the sole structure of FIG. 1 showing a foot-facing surface.
Figure 3:
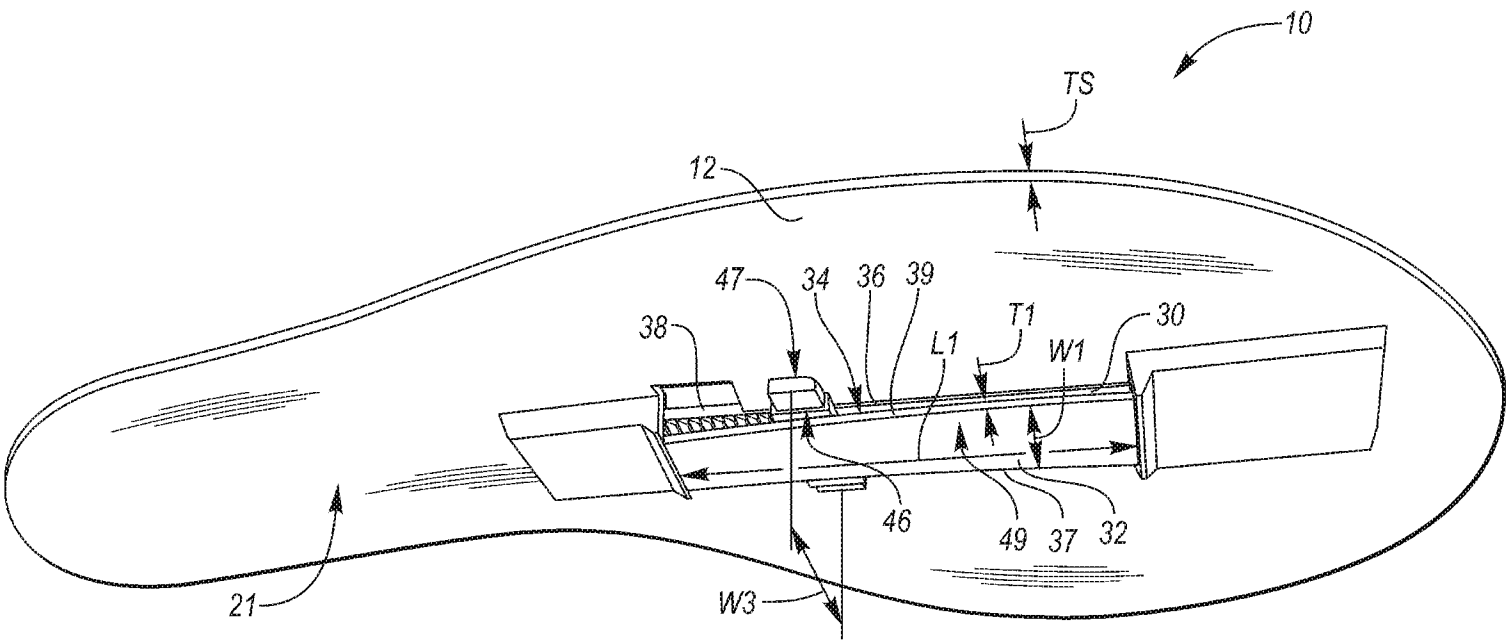
FIG. 3 is a schematic illustration in perspective view of the sole structure of FIG. 1 showing a ground-facing surface.

Referring to FIGS. 1-3, the sole structure 10 includes the sole plate 12 and a piston 28, and may include one or more additional plates, layers, or components, as discussed herein. The article of footwear 11 of FIGS. 4B-4C includes both the sole structure 10 and an upper 13 (shown in phantom in FIGS. 4B-4C). The sole plate 12 is configured to be operatively connected to the upper 13 as discussed herein. The upper 13 may incorporate a plurality of material elements (e.g., textiles, foam, leather, and synthetic leather) that are stitched or adhesively bonded together to form an interior void for securely and comfortably receiving a foot 53 as shown. In addition, the upper 13 may include a lace or other tightening mechanism that is utilized to modify the dimensions of the interior void, thereby securing the foot 53 within the interior void and facilitating entry and removal of the foot 53 from the interior void. Accordingly, the structure of the upper 13 may vary significantly within the scope of the present teachings.

The sole structure 10 is secured to the upper 13 and has a configuration that extends between the upper 13 and the ground G (indicated in FIG. 4B). The sole plate 12 may or may not be directly secured to the upper 13. Sole structure 10 may attenuate ground reaction forces (i.e., provide cushioning for the foot 53), and may provide traction, impart stability, and limit various foot motions.

In the embodiment shown, the sole plate 12 is a full-length, unitary sole plate 12 that has a forefoot region 14, a midfoot region 16, and a heel region 18. In other embodiments, the sole plate 12 may be a partial length plate member. For example, in some cases, the sole plate 12 may include only a forefoot region 14 and may be operatively connected to other components of the article of footwear that comprise a midfoot region and a heel region. The sole plate 12 provides a foot support portion 19 that includes a foot-facing surface 20 (also referred to as a foot-receiving surface).

The foot-facing surface 20 extends over the forefoot region 14, the midfoot region 16, and the heel region 18. The foot support portion 19 includes the majority of the sole plate 12 at the foot-facing surface 20, and supports the foot 53 but is not necessarily directly in contact with the foot 53. For example, an insole, midsole, strobel, or other layers or components may be positioned between the foot 53 and the foot-facing surface 20.

The sole plate 12 has a medial side 22 and a lateral side 24. As shown, the sole plate 12 extends from the medial side 22 to the lateral side 24. As used herein, a lateral side of a component for an article of footwear, including the lateral side 24 of the sole plate 12, is a side that corresponds with an outside area of the human foot 53 (i.e., the side closer to the fifth toe of the wearer). The fifth toe is commonly referred to as the little toe. A medial side of a component for an article of footwear, including the medial side 22 of the sole plate 12, is the side that corresponds with an inside area of the human foot 53 (i.e., the side closer to the hallux of the foot of the wearer). The hallux is commonly referred to as the big toe. Both the medial side 22 and the lateral side 24 extend along a periphery of the sole plate 12 from a foremost extent 25 to a rearmost extent 29 of the sole plate 12.

The term "longitudinal", as used herein, refers to a direction extending along a length of the sole structure 10, e.g., extending from the forefoot region 14 to the heel region 18 of the sole structure 10. The term "transverse", as used herein, refers to a direction extending along the width of the sole structure 10, e.g., extending from the medial side to the lateral side of the sole structure 10. The term "forward" is used to refer to the general direction from the heel region 18 toward the forefoot region 14, and the term "rearward" is used to refer to the opposite direction, i.e., the direction from the forefoot region 14 toward the heel region 18. The terms "anterior" and "fore" are used to refer to a front or forward component or portion of a component. The term "posterior" and "aft" are used to refer to a rear or rearward component or portion of a component.

The heel region 18 generally includes portions of the sole plate 12 corresponding with rear portions of a human foot, including the calcaneus bone, when the human foot is supported on the sole structure 10 and is a size corresponding with the sole structure 10. The forefoot region 14 generally includes portions of the sole plate 12 corresponding with the toes and the joints connecting the metatarsal bones with the phalange bones of the human foot (interchangeably referred to herein as the "metatarsal-phalangeal joints" or "MPJ" joints). The midfoot region 16 generally includes portions of the sole plate 12 corresponding with an arch area of the human foot, including the navicular joint. Regions 14, 16, 18 are not intended to demarcate precise areas of the sole structure 10. Rather, regions 14, 16, 18 are intended to represent general areas relative to one another, to aid in the following discussion. In addition to the sole structure 10, the relative positions of the regions 14, 16, 18, and medial and lateral sides 22, 24 may also be applied to the upper 13, the article of footwear 11, and individual components thereof.

The sole plate 12 is referred to as a plate, and is generally but not necessarily flat. The sole plate 12 need not be a single component but instead can be multiple interconnected components. For example, both an upward-facing portion of the foot-facing surface 20 and the opposite ground-facing surface 21 may be pre-formed with some amount of curvature and variations in thickness when molded or otherwise formed in order to provide a shaped footbed and/or increased thickness for reinforcement in desired areas. For example, the sole plate 12 could have a curved or contoured geometry that may be similar to the lower contours of the foot 53. The sole plate 12 may have a contoured periphery (i.e., along the medial side 22 and the lateral side 24) that slopes upward toward any overlaying layers, such as a midsole or the upper 13.

The sole plate 12 may be entirely of a single, uniform material, or may have different portions comprising different materials. For example, a first material of the forefoot region 14 can be selected to achieve, in conjunction with the piston 28 and other features and components of the sole structure 10 discussed herein, the desired bending stiffness in the forefoot region 14, while a second material of the midfoot region 16 and/or the heel region 18 can be a different material that has little effect on the bending stiffness of the forefoot region 14. By way of non-limiting example, the second portion can be over-molded onto or co-injection molded with the first portion. Example materials for the sole plate 12 include durable, wear resistant materials. For example, a thermoplastic elastomer, such as thermoplastic polyurethane (TPU), a glass composite, a nylon including glass-filled nylons, a spring steel, carbon fiber, ceramic or a foam or rubber material (such as but not limited to a foam or rubber with a Shore A Durometer hardness of about 50-70 (using ASTM D2240-05(2010) standard test method) or an Asker C hardness of 65-85 (using hardness test JIS K6767 (1976))) may be used for the sole plate 12.

In the embodiment shown, the sole plate 12 may be an inner board plate, also referred to as an inner board, an insole board, or a lasting board. The sole plate 12 may instead be an outsole. Still further, the sole plate 12 could be a midsole plate or a unisole plate, or may be any combination of an inner board plate, a midsole plate, or an outsole. For example, in FIG. 4B, the sole plate 12 is shown with traction elements 69. The traction elements 69 may be integrally formed as part of the sole plate 12 (e.g., if the sole plate is an outsole or a unisole plate), may be attached to the sole plate 12, or may be formed with or attached to another plate underlying the sole plate 12, such as if the sole plate 12 is an inner board plate and the sole structure 10 includes an underlying outsole. For example, the traction elements 69 may be integrally formed cleats. In other embodiments, the traction elements may be, for example, removable spikes. The traction elements 69 protrude below the ground-facing surface 21 of the sole plate 12. Direct ground reaction forces on the sole plate 12 that could affect operation of the piston 28 are thus minimized. In other embodiments, however, the sole structure 10 may have no traction elements 69, the ground-facing surface 21 may be the ground-contact surface, or other plates or components may underlie the sole plate 12.

With reference to FIGS. 1 and 3, an opening 30 extends through the foot support portion 19 of the sole plate 12 from the foot-facing surface 20 to a ground-facing surface 21 of the sole plate 12 that is best shown in FIG. 3. A bridge portion 32 of the sole plate 12 underlies the opening 30 and is secured to (i.e., extends as a unitary part of) the foot support portion 19 fore and aft of the opening 30. The bridge portion 32 is operatively secured to the foot support portion 19. As used herein, the bridge portion 32 is "operatively secured" to the foot support portion 19 when it is directly or indirectly attached to the foot support portion 19. In the embodiment of FIGS. 1-6D, the bridge portion 32 is a unitary part of and is of the same material as the foot support portion 19.

As best shown in FIG. 3, the bridge portion 32 is recessed below the foot support portion 19. Stated differently, a foot-facing surface 34 of the bridge portion 32 is below the ground-facing surface 21 of the foot support portion 19, at least when the sole plate 12 is in an unflexed, relaxed state as in FIGS. 1-3. The bridge portion 32 is generally the same size and shape as the opening 30, and both are disposed lengthwise along a longitudinal midline LM of the sole plate 12. The bridge portion 32 has a thickness T1, a width W1 greater than the thickness T1, and a length L1 greater than the width W1.

Due to the disposition of the bridge portion 32 below the foot support portion 19, slots 36 are formed between the ground-facing surface 21 of the foot support portion 19 and the bridge portion 32. The slots 36 run along the length L1 of the bridge portion 32 at the medial side 37 and the lateral side 39 of the bridge portion 32. The lateral slot 36 is visible in FIGS. 1 and 3, and the medial slot 36 is indicated in FIG. 1 between the sole plate 12 and the medial side 27 (shown in hidden lines) of the piston 28.

The piston 28 is shown slightly inverted in FIG. 1 relative to its assembled and in-use position of FIGS. 2 and 3 in order to expose the teeth 56. The piston 28 has an elongated body 38 with a width W2 slightly less than the width of the opening 30 so that the body 38 can extend through the opening 30. The piston 28 also has a support arm 40 that extends transversely from the body 38. The width W3 of the support arm 40 is greater than the width W1 of the bridge portion 32 and greater than the width W2 of the piston body 38 as shown in FIGS. 2 and 3. Referring to FIG. 1, notches 42 in the foot support portion 19 at the opening 30 create a transverse expanse of the opening 30 that has a width W4 greater than the width W3 of the support arm 40. When the piston 28 is placed above the sole plate 1 with the teeth 56 facing downward, the support arm 40 can be dropped through the opening 30 at the notches 42 so that the bottom surface 46 of the support arm 40 rests on the foot-facing surface 34 of the bridge portion 32, and the upper surface 47 of the support arm 40 is below the ground-facing surface 21 as shown in FIG. 3. In other words, the body 38 extends through the opening 30, and the support arm 40 is supported on the bridge portion 32. The foot-facing surface 48 of the piston 28 may rest below or generally level with the foot-facing surface 20 of the foot support portion 19 when the piston 28 is inserted in the opening 30 as described and the sole structure 10 is in an unflexed, generally relaxed state as shown in FIG. 2. If the foot-facing surface 48 rests sufficiently below the foot-facing surface 20, the foot support portion 19 can extend directly over the guide track 50 and the bridge portion 32 so that the foot-facing surface 48 is nested below the foot support portion 19.

With reference to FIG. 1, the sole plate 12 includes a guide track 50 slightly recessed at the foot-facing surface 20. The guide track 50 is shown to have two sections 50A, 50B. A forward section 50A is forward of the bridge portion 32, and a rear section 50B is rearward of the bridge portion 32. In an alternative embodiment, either only the forward section 50A, or only the rearward section 50B of the guide track 50 may be provided. The guide track 50 has a series of protrusions 52. In the embodiment shown, the protrusions 52 are gear teeth and the guide track 50 is a linear gear, also referred to as a rack. The gear teeth 52 have a profile angle that inclines toward tips 54 of the teeth 52 in a forward direction.

The piston 28 also has at least one protrusion 56. In the embodiment shown, the piston 28 has a series of protrusions 56 that are gear teeth. The teeth 56 have a profile angle that inclines toward tips 58 of the teeth 56 in a rearward direction when the piston 28 is in its in-use position of FIGS. 2 and 3. The teeth 56 are divided into a forward section 56A and a rearward section 56B.

It should be appreciated that the overall length L2 of the piston 28 is less than the length L3 of the guide track 50 from a front of the forward section 50A to a rear of the rearward section 50B. The relative size of the piston 28 and guide track 50 is best shown in FIG. 2. The length L2 is greater than the length L1, but less than the length L3. The lengths L2 and L3 are such that, when the arm 40 is disposed through the notches 42, the rearward section 50B engages with the rear section 56B, and a forward-most tooth 56C of the piston 28 is engaged with a rearmost tooth 52C of the forward section 50A so that teeth 52 forward of the tooth 52C are not yet engaged with any teeth of the piston 28. In other embodiments, the tooth 56C could be engaged with a tooth forward of tooth 52C, but in all embodiments, when the piston 28 is in a rearmost position, at least some of the teeth 52 of the forward section 50A are forward of tooth 56C. This provides room for the piston 28 to progress forward relative to the sole plate 12 during dorsiflexion. In other words, the tooth 56C is engaged with the tooth 52C, and ratchets the piston 28 along the guide track 50 as the piston 28 translates relative to the sole plate 12 with repetitive dorsiflexion of the sole structure 10.

Figure 6A:
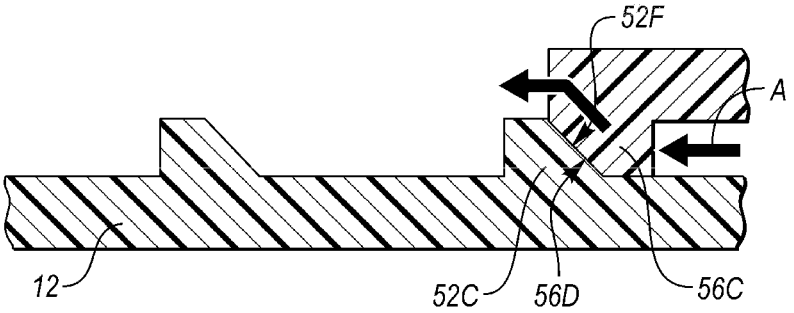
FIG. 6A is a schematic illustration in cross-sectional fragmentary view of an engagement feature of the piston sliding up a tooth of a track of the sole plate during dorsiflexion of the sole structure.
Figure 6B:
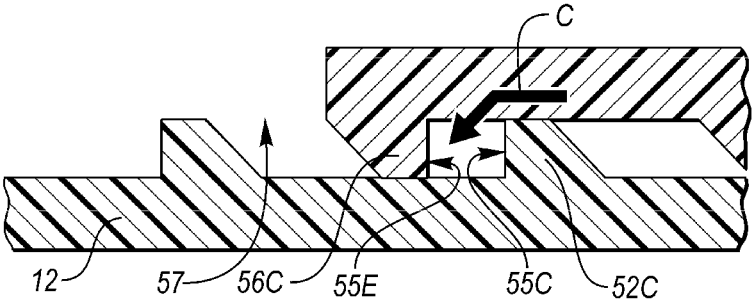
FIG. 6B is a schematic illustration in cross-sectional fragmentary view of the engagement feature of the piston of FIG. 6A after moving over the tooth.

FIG. 6A shows the tooth 52C relative to tooth 56C as the piston 28 begins to move during dorsiflexion, and FIG. 6B represents a subsequent position of tooth 52C relative to tooth 56C when the sole structure 10 flexed at a flex angle A1 during an initial dorsiflexion with the forefoot region 14 of the sole structure operatively engaged with the ground G (such as through traction elements 69). A removable pin (not shown) may extend through the piston 28 and sole plate 12 to temporarily maintain the piston 28 in the initial position until ratcheting of the piston 28 and is desired. For example, the pin may be removed at the beginning of a race. A similar pin may be used in any of the embodiments described herein. During dorsiflexion, and assuming any such pin is removed, the sole plate 12 and the piston 28 will be flexed so that the mating gear tooth faces 52F, 56D of teeth 52C, 56C, respectively, will be tilted relative to the position shown in FIG. 6A to a horizontal disposition or even further, and the forward weight of the foot 53 (arrow A) will urge the piston 28 to move forward relative to the sole plate 12. FIGS. 6A and 6B show the resulting progression of the tooth 56C up (arrow B) and over (arrow C) the tooth 52C of the guide track 50.

Figure 6C:
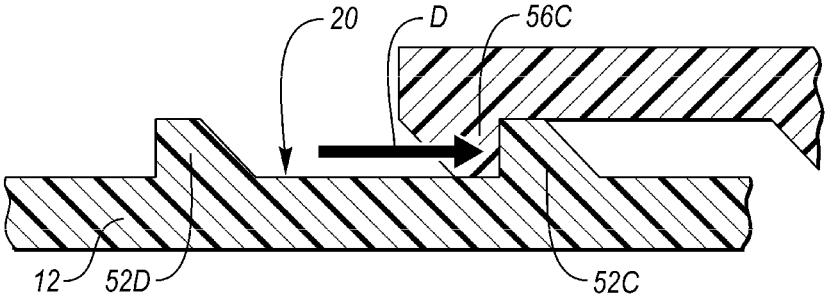
FIG. 6C is a schematic illustration in cross-sectional fragmentary view of the engagement feature of the piston of FIG. 6A sliding back toward the tooth following dorsiflexion.
Figure 6D:
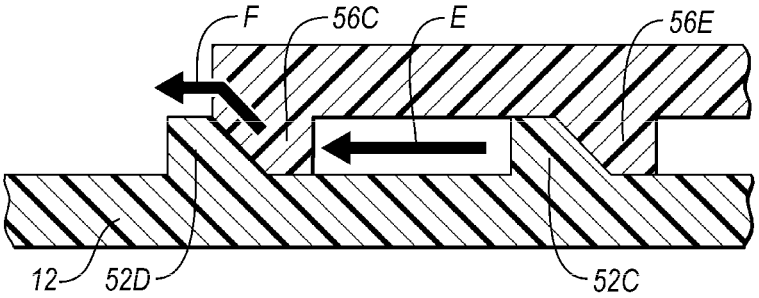
FIG. 6D is a schematic illustration in cross-sectional fragmentary view of the engagement feature of the piston sliding up a subsequent tooth of the track of the sole plate during a subsequent dorsiflexion of the sole structure.

Following the initial dorsiflexion, as the foot 53 plantar flexes and lifts the forefoot region 14 of the article of footwear 11 out of operative engagement with the ground G, and then the article of footwear 11 comes into contact with the ground G at a point rearward of the forefoot region 14, such as at the heel region 18 or even a more rearward part of the forefoot region 14 during a sprint, the foot 53 no longer urges the piston 28 forward relative to the sole plate 12. The foot 53 may urge the piston 28 rearward relative to the sole plate 12, as indicated by arrow D in FIG. 6C showing relative movement of the piston 28 rearward. The faces 55C, 55E of the gear teeth 52C, 56C opposite to the inclined faces are substantially perpendicular to the foot-facing surface 20 and to the bottom surface 57 of the piston 28, and prevent further movement of the piston 28 rearward relative to the sole plate 12. In a subsequent dorsiflexion with the forefoot region 14 in operative engagement with the ground G, the process repeats, and the tooth 56C progresses up and over the next forward tooth 52D, as indicated with arrows E and F in FIG. 6D, with the next rearward tooth 56E of the piston 28 now encountering the tooth 52C. In this manner, the tooth 56C continues to ratchet the piston 28 forward relative to the sole plate 12 tooth by tooth along the series of teeth 52 with repeated dorsiflexion of the sole structure 10 until the tooth 56C progresses over the forward-most tooth 52E of the series of teeth 52, shown in FIG. 1. The piston 28 then remains in the forward-most position during any further dorsiflexion as the front wall 61 of the foot support portion 19 forward of the forward section 56A in combination with the downward force of the wearer prevents forward motion of the piston 28 relative to the sole plate 12.

As will be understood by those skilled in the art, during bending of the sole structure 10 as the foot 53 is dorsiflexed, there is a layer in the sole plate 12 referred to as a neutral plane (although not necessarily planar) or a neutral axis NB above which the sole plate 12 is in compression, and below which the sole plate 12 is in tension. It should be appreciated that the neutral axis NB is not the bend axis about which bending occurs. The bend axis BA is positioned above the foot-facing surface 20, and represents the axis about which the foot 53 bends. The position of the bend axis BA changes as the foot 53 progresses through dorsiflexion. Those skilled in the art will appreciate that portions of the sole plate 12 (such as portions of the sole plate 12 near the foot-facing surface 20) may be placed in compression during dorsiflexion of the sole plate 12, while other portions of the sole plate 12, (such as portion of the sole plate 12 near the ground-facing surface 21) may be placed in tension during dorsiflexion of the sole plate 12. The greater the distance from the neutral axis NB that the compressive and tensile forces of the sole plate 12 are applied, the greater the bending stiffness of the sole plate 12. FIG. 4B indicates that the sole plate 12 has a compressive portion CP above the neutral axis NB and a tensile portion TP below the neutral axis NB. The bridge portion 32 is below the neutral axis NB and is thus in tension. The bridge portion 32 is thus also referred to herein as a tensile portion of the sole plate 12. Generally, greater torque is required to bend material that is further displaced from the neutral bend axis NB, and greater compressive or tensile forces act on the material. Accordingly, increasing the relative distance between the neutral axis NB and the compressive forces and/or the tensile forces increases the bending stiffness of the sole plate 12, whereas decreasing the relative distance between the neutral axis NB and the compressive forces and/or the tensile forces decreases the bending stiffness of the sole plate 12.

As the piston 28 ratchets along the series of teeth 52, the bending stiffness of the sole structure 10 varies in accordance with the position along the longitudinal axis of the arm 40 of the piston 28. The arm 40 interferes with movement of the bridge portion 32 and the foot support portion 19 toward the neutral axis NB. FIG. 4A shows the sole plate 12 with the piston 28 removed. During dorsiflexion of the sole plate 12, the sole plate 12 can relieve bending forces to the extent that the bridge portion 32 can rise up relative to the foot support portion 19 at the lateral and medial sides of the opening 30. Without the piston 28 in place, the midsection 32A of the bridge portion 32 is free to flex or bend by rising up toward the foot-facing surface 20, and the medial section 19A of the foot support portion 19 and the lateral section 19B of the foot support portion 19 adjacent the opening 30 are free to bend by moving downward toward the bridge portion 32. Of course, with the weight of a foot 53 on the sole plate 12, the midsection 32A of the bridge portion 32 will not move up further than the foot-facing surface 20. FIG. 4A shows movement of the midsection 32A beyond the foot-facing surface 20 only because no foot or sole component is shown over the bridge portion 32.

Allowing the midsection 32A of the bridge portion 32 to move upward and the medial and lateral sections 19A, 19B of the foot support portion 19 at the medial and lateral sides of the opening 30 to move downward aligns the midsection 32A with the medial and lateral sections 19A, 19B (assuming a foot 53 or other component is above the bridge portion 32 to prevent its upward movement beyond the foot-facing surface 20). This causes the sole plate 12 to behave in bending (i.e., to exhibit a similar bending stiffness) as a single piece of material having an approximate thickness equal to the thickness TS of the sole plate 12 (see FIG. 3) at the bending area. Conversely, if the midsection 32A cannot rise up (i.e., if no relative movement of the midsection 32A and the medial and lateral sections 19A, 19B is possible), then the sole plate 12 behaves in bending as a piece of material having a thickness D2 equivalent to the distance from the foot-facing surface 20 to the bottom surface of the bridge portion 32 indicated in FIGS. 1 and 4C. Bending stiffness can be further varied by providing the bridge portion 32 with a varying thickness in the longitudinal direction.

In FIGS. 4B-4C, the effective thickness discussed with respect to bending stiffness is at the portion of the sole plate 12 below the metatarsal-phalangeal joints. As is understood by those skilled in the art, torque on the sole structure 10 results from a force applied at a distance from a bending axis BA located in the proximity of the metatarsal-phalangeal joints, as occurs when a wearer flexes the sole structure 10. A flex angle μl is defined as the angle formed at the intersection between a first axis LM1 and a second axis LM2. The first axis LM1 generally extends along the longitudinal midline LM of the sole plate 12 at the ground-facing surface 21 of the sole plate 12 at a forward part of the bridge portion 32. The second axis LM2 generally extends along the longitudinal axis LM of the sole plate 12 at the ground-facing surface 21 of the sole plate 12 at a rearward part of the bridge portion 32. The sole plate 12 is configured so that the intersection of the first axis LM1 and the second axis LM2 is approximately centered both longitudinally and transversely below the metatarsal-phalangeal joints of the foot 53 supported on the foot-facing surface 20 of the sole plate 12. Changing or repositioning the arm 40 relative to the bridge portion 32 of the sole plate 12 changes the bending stiffness that the sole plate 12 exhibits at similar flex angles A1. In other words, the sole plate 12 may exhibit a first bending stiffness at a specific flex angle A1 with the arm 40 in the first position of FIG. 4B, and exhibit a second bending stiffness at the same specific flex angle A1 with the arm 40 in the second position of FIG. 4C, and other bending stiffness values with the arm 40 at other positions corresponding with different positions of the piston 28 along the guide track 50.

Figure 5:
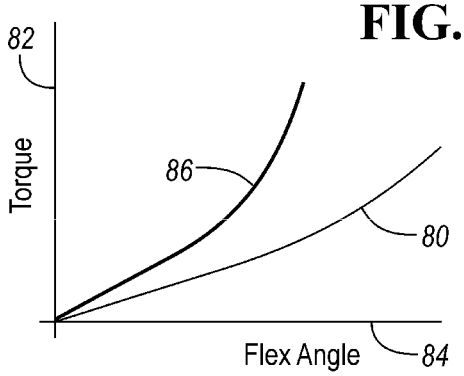
FIG. 5 is a plot of torque versus flex angle for the sole structure showing a bending stiffness of the sole structure with the piston in the first position of FIG. 4B, and a bending stiffness of the sole structure with the piston in the second position of FIG. 4C.

As a wearer's foot 53 dorsiflexes by lifting the heel region 18 away from the ground G, while maintaining contact with the ground G at the forefoot region 14, it places torque on the sole structure 10 and causes the sole plate 12 to flex through the forefoot region 14. Referring to FIG. 5, an example plot indicating the bending stiffness (slope of the line) of the sole plate 12 with the arm in the first position is generally shown at 80. Torque (in Newton-meters) is shown on a vertical axis 82, and the flex angle (in degrees) is shown on a horizontal axis 84. As is understood by those skilled in the art, the torque results from a force applied at a distance from a bending axis located in the proximity of the metatarsal-phalangeal joints, as occurs when a wearer flexes the sole structure 10. The bending stiffness of the sole plate 12 may be constant (thus the plot would have a linear slope) or substantially linear, or may increase gradually (which would show a change in slope with changes in flex angle). As shown in the exemplary plot of FIG. 5, the bending stiffness is nonlinear, and increases exponentially and with a positive rate of change of stiffness. Alternatively, the bending stiffness could be nonlinear with a negative rate of change of stiffness with increasing flex angle, or could be linear.

The arm 40 of the piston 28 changes the ability of the sole plate 12 and bridge portion 32 to align as described. With reference to FIG. 4B, when the piston 28 is in the rearmost position in which the arm 40 is directly below the notches 42 and a rear end 60 of the piston 28 (shown in FIG. 1) is adjacent and possibly abutting a rear wall 62 of the foot support portion 19 rearward of the section 50B, the support arm 40 is trapped below the foot support portion 19 and above the bridge portion 32. The support arm 40 prevents relative movement of the bridge portion 32 toward the foot support portion 19 at the support arm 40. Any relative movement of the bridge portion 32 toward the foot support portion 19 can only occur forward of the support arm 40. With the support arm 40 inserted through the opening 30 as shown, the midsection 32A of the bridge portion 32 has some movement toward the foot support portion 19, but cannot raise toward the foot support portion 19 as much as it could when the piston 28 was removed in FIG. 4A. This causes the sole plate 12 to behave in bending (i.e., to exhibit a similar bending stiffness) as a sole plate having a thickness D1 equivalent to the distance from the foot-facing surface 20 to the bottom surface 49 of the bridge portion 32, and bending stiffness is thus higher than in FIG. 4A.

When the piston 28 ratchets as described with respect to FIGS. 5A-5D, the support arm 40 moves forward with the body 38, shortening the portion of the bridge portion 32 that is forward of the support arm 40. The piston 28 is moved relative to the sole plate 12 by dorsiflexion of the sole plate 12, with the bridge portion 32 in tension, the foot support portion 19 in compression, and the support arm 40 separating the bridge portion 32 and the foot support portion 19. When the support arm 40 moves forward of the notches 42, the support arm 40 is trapped below the ground-facing surface 21 by the foot support portion 19, and extends under the foot support portion 19 at medial and lateral sides 51A, 51B of the opening 30. The upper surface 47 of the support arm 40 will be in contact with the ground-facing surface 21 at least during dorsiflexion. For example, when the support arm 40 is at the position shown in FIG. 4C, representing the forward-most position in which the forward edge 63 of the piston 28 abuts the front wall 61 of the foot support portion 19 forward of the section 50A (i.e., slightly more forward than shown in FIG. 2), the arm 40 is in the position shown in FIG. 4C. In this position, the arm 40 prevents relative movement of the midsection 32A of the bridge portion 32 toward the medial and lateral sections 19A, 19B so the sole structure 10 behaves in bending as a sole plate having the thickness D2 equivalent to the distance from the foot-facing surface 20 to the bottom surface 49 of the bridge portion 32.

The support arm 40 thus moves with the piston 28 along the longitudinal midline LM of the sole structure 10 to alter or change the bending stiffness of the sole structure 10. The support arm 40 is at least a semi-rigid material. The substantially semi-rigid material may include any material having a durometer of 50D or greater. For example, the support arm 40 may be a metal, such as stainless steel or aluminum, or may alternatively include a plastic, such as a nylon material or a thermoplastic polyurethane, although the embodiments are not limited only to those examples listed here, but can also include other similarly and suitably semi-rigid or rigid materials. The support arm 40 extends transversely relative to the longitudinal midline LM and is interlaced with the lateral section 19B of the foot support portion 19 at the lateral side of the bridge portion 32, with the bridge portion 32, and with the medial section 19A of the foot support portion 19 at the medial side of the bridge portion 32.

The bending stiffness of the sole plate 12 provides the resistance against dorsiflexion of the sole plate 12 in the longitudinal direction along the longitudinal midline LM of the sole plate 12. In other words, when the arm 40 is moved forward from the first position of FIG. 4B, the bending stiffness of the sole plate 12 is changed at any specific flex angle when compared to the bending stiffness profile of the sole plate 12 with the arm 40 in the first position at the same flex angle. Accordingly, as shown in FIG. 5, the bending stiffness shown by line 80, with the arm 40 in the first position, is less than the bending stiffness shown by line 86, with the arm 40 in the second position.

Figure 7:
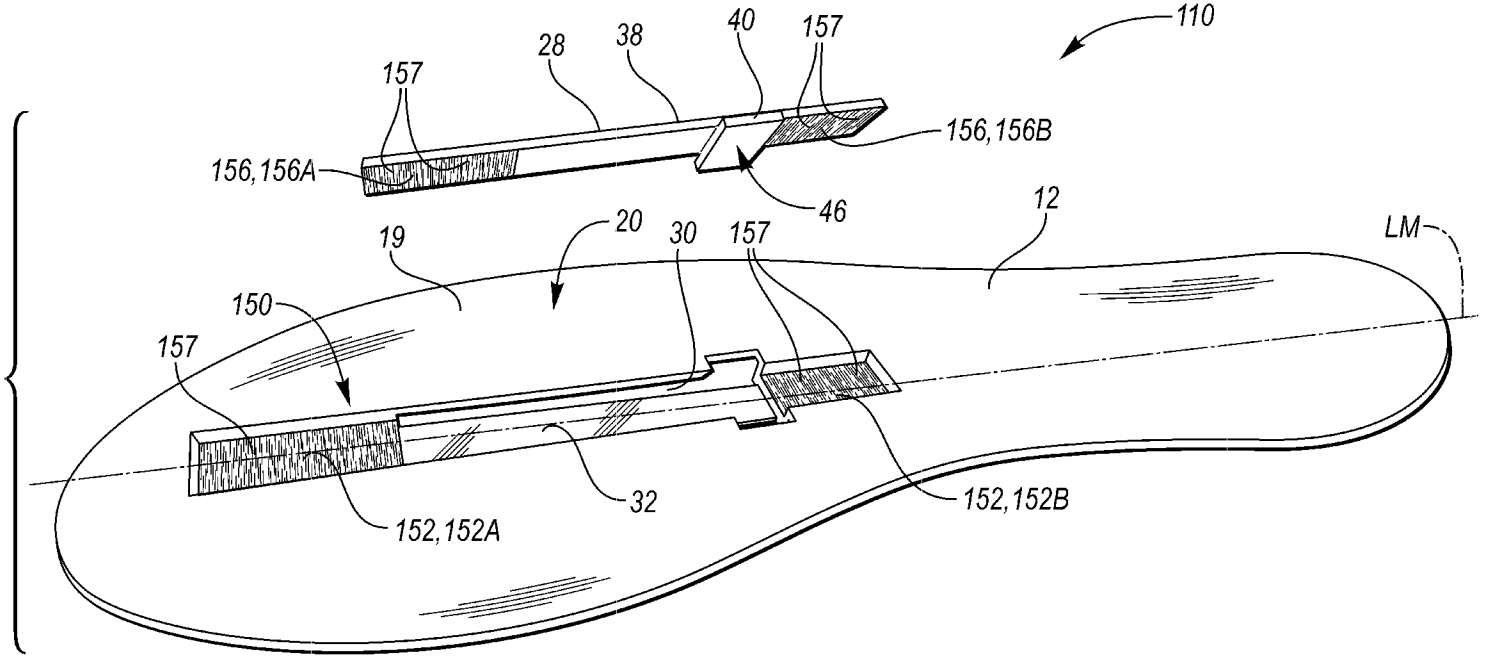
FIG. 7 is a schematic illustration in exploded perspective view of an alternative embodiment of a sole structure showing a foot-facing surface of a sole plate.

FIG. 7 shows another embodiment of a sole structure 110 within the scope of the present teachings. The sole structure 110 is configured with many of the same components that function in the same manner as described with respect to sole structure 10 and are referred to with the same reference numbers. Instead of a guide track with teeth, the sole plate 12 has a guide track 150 that has a first set of directional fibers 152. The first set of directional fibers 152 is divided into a forward section 152A forward of the opening 30 and the bridge portion 32, and a rear section 152B rearward of the opening 30 and the bridge portion 32. Instead of a tooth as an engagement feature, the piston 28 has a second set of directional fibers 156 that engages with the first set of directional fibers 152. The second set of directional fibers 156 has a forward section 156A and a rearward section 156B. The forward section 156A engages with the forward section 152A, and the rearward section 156B engages with the rear section 152B. The directional fibers 152, 156 are configured to allow the directional fibers 156 to incrementally ratchet forward over the directional fibers 152 under the force of the foot 53 shown as arrow A and described with respect to FIG. 6A. The directional fibers 152, 156 are arranged as parallel rows of individual fibers 157 laid transverse to the longitudinal midline LM. The fibers 157 protrude from the sole plate 12, and may be nylon, mohair, or a combination thereof, similar to ski skins on a cross-country ski. A backing of the fibers 152, 156 can be adhered to the sole plate 12 and to the piston 28. Once the directional fibers 156 advance forward on the directional fibers 152, the protrusions of the fibers 157 are sufficient to prevent rearward movement, as any rearward force of the fibers 156 relative to the fibers 152 is less than the forward force of the fibers 156 against the fibers 152, represented by arrow A in FIG. 6A and experienced during dorsiflexion.

Figures 8, 9:
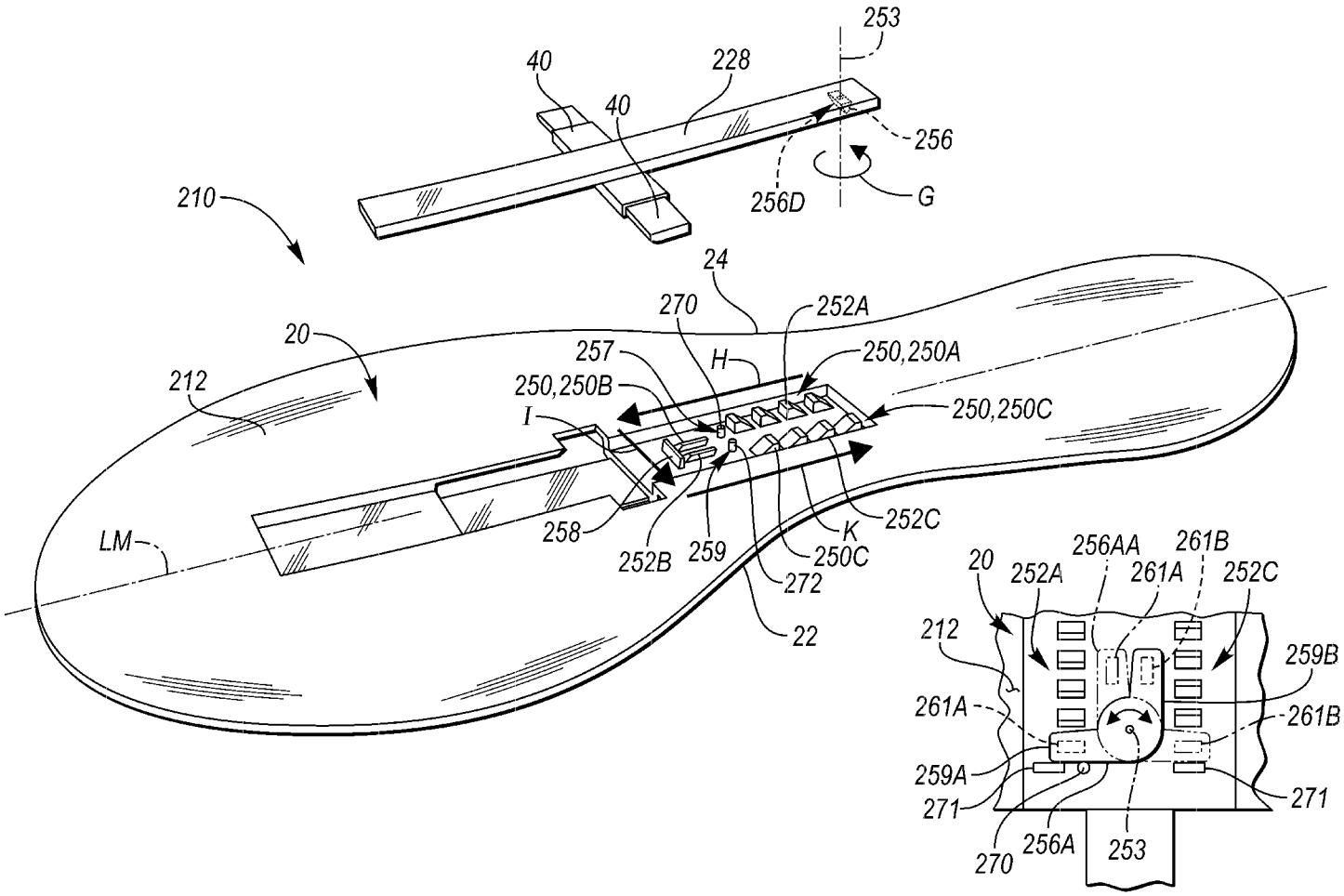
FIG. 8 is a schematic illustration in exploded perspective view of another alternative embodiment of a sole structure showing a foot-facing surface of a sole plate.
FIG. 9 is a schematic illustration of an alternative pivotable tooth and post for the sole structure of FIG. 8.

FIG. 8 shows another embodiment of a sole structure 210 within the scope of the present teachings. The sole structure 210 is configured with many of the same components that function in the same manner as described with respect to sole structure 10 and are referred to with the same reference numbers. The sole structure 210 has a piston 228, and is configured with a sole plate 212 that has posts 270, 272 and a segmented guide track 250 that enable the piston 228 to move forward, transversely, and rearward relative to the sole plate 212. More specifically, the guide track 250 has a first segment 250A with a first series of teeth 252A, and a second segment 250B with a second series of teeth 252B. The second segment 250B is oriented at a first angle with respect to the first segment 250A. In the embodiment shown, the first angle is a 90 degree angle. The first series of teeth 252A progress incline in a forward longitudinal direction, progressing in a forward longitudinal direction along the sole plate 212. The second series of teeth 252B progress in a transverse direction along the sole plate 212, inclining in a direction from the lateral side toward the medial side 22. Accordingly, the piston 228 is ratcheted along the second series of teeth 252B in a transverse direction at a 90 degree angle with respect to the direction that it is ratcheted along the first series of teeth 252A. The guide track 250 also has a third segment 250C with a third series of teeth 252C. The third segment 250C is oriented at a second angle with respect to the second segment 250B. In the embodiment shown, the second angle is 90 degrees. The third series of teeth 252C incline in a rear longitudinal direction, thus progressing in an opposite direction as the first series of teeth 252A so that the piston 228 is ratcheted in the opposite direction along the third series of teeth 252C. In other embodiments, the first, second, and third segments could be arranged at other angles relative to one another, so that the piston 228 progresses in a different manner. For example, the third segment could be arranged forward of the second segment, so that the third series of teeth progresses in the forward longitudinal direction, just as the first series of teeth. A fourth segment could be arranged between the third segment and the first segment to direct the piston 228 transversely from the third segment back to the first segment, so that the piston 228 loops around the four segments. The segments may correspond to portions of a race in which increasing longitudinal stiffness is first desired (i.e., when the piston 228 moves along the first segment 250A), followed at some point by decreasing longitudinal stiffness (i.e., when the piston 228 moves along the third segment 250C).

The sole plate 212 has a first post 270 and a second post 272 both of which extend upward at the foot-facing surface 20 of the sole plate. The first post 270 is positioned between the first segment 250A and the second segment 250B. The piston 228 has a pivotable tooth 256 that extends downward and interfaces with the teeth 252A, 252B, 252C as described with respect to teeth 56 and teeth 52 in FIG. 1. The tooth 256 has a ramped surface 256D that encounters the inclining faces of the teeth 252A, 252B, 252C as described with respect to face 56D of tooth 56C encountering face 52F of tooth 52C. In order to encounter the inclining faces which incline in different directions as shown and described, the tooth 256 is pivotable about a center axis 253 extending from the base to the tip of the tooth 256. The tooth 256 is configured so that it is pivotable upon encountering sufficient force off-centered from its axis 253 so as to cause the tooth to rotate about its axis by 90 degrees in the direction indicated by arrow G.

The first post 270 is positioned off center from the tooth 256, and may have a rounded contact surface 257 that pivots the tooth 256 so that when the first post 270 contacts the tooth 256, and the dorsiflexion force indicated by arrow A in FIG. 6A is applied by the tooth 256 against the first post 270, the tooth 256 pivots by the first angle (i.e., 90 degrees counter-clockwise in the embodiment shown). The tooth 256 may be held in place with friction between the tooth 256 and the bottom surface of the piston 228, which friction is overcome by the force of the offset post 270 against the tooth 256.

After the tooth 256 is pivoted, its ramped surface 256D now faces the ramped surfaces of the teeth 252B, and further dorsiflexion of the sole structure 210 will cause the piston 228 to ratchet along the second series of teeth 252B. The second series of teeth 252B incline in a transverse direction, from the lateral side 24 to the medial side 22 in the embodiment shown. A forward wall 258 at the forward edge of the teeth 252B prevents the tooth 256 from progressing forward as it moves along the second segment 250B. The arm 40 does not move forward as the piston progresses along the second series of teeth, so the ability of the bridge portion 32 to flex is unchanged and bending stiffness in dorsiflexion does not vary as the piston 228 progresses over the second series of teeth 252B.

The second post 272 is between the second segment 250B and the third segment 250C. and is off-centered from the tooth 256 such that the tooth 256 encounters the second post 272 and is caused to pivot along a rounded surface 259 of the second post 272 to rotate about its axis by 90 degrees in the direction indicated by arrow G. The second post 272 extends upward at a position off-centered from the tooth 256 so that when the second post 272 contacts the tooth 256, and the dorsiflexion force indicated by arrow A in FIG. 6A is applied by the tooth 256 against the second post 272, the post 272 pivots the tooth 256 by the second angle (i.e., by 90 degrees counter-clockwise in the embodiment shown). After the tooth 256 is pivoted, its ramped surface 256D now faces the ramped surfaces of the teeth 252C, and further dorsiflexion of the sole structure 210 will cause the piston 228 to ratchet along the second series of teeth 252C, progressing rearward.

The first series of teeth 252A progress in a forward direction along the sole plate 212 and the third segment 250C progress in a rearward direction along the sole plate 212 so that the piston 228 is ratcheted forward along the first series of teeth 252A, and is ratcheted rearward along the third segment 250C. Accordingly, the sole structure 210 will have increasing stiffness as the piston 228 progresses along the first series of teeth 252A, and decreasing stiffness as the piston 228 progresses along the third segment 250C, in accordance with the location of the arm 40 as described with respect to the embodiment shown in FIGS. 4B-4C.

Alternatively, the tooth 256 may be generally L-shaped, as illustrated by tooth 256A in FIG. 9, in which case the sole plate 312 need only have the first series of teeth 252A and the third series of teeth 252C need be provided. Each of the arms 259A, 259B has an engaging portion. The engaging portion 261A of arm 259A engages with teeth 252A when the piston 228 is moving forward, and the engaging portion 261B of arm 259B engages with teeth 252C when the piston 228 is moving rearward. As the piston 228 progresses forward along the first series of teeth 252A, the first arm 259A of the tooth 256A interferes with the post 270, causing the tooth 256A to pivot 90 degrees clockwise to the position 256AA shown in FIG. 9. Stoppers 271 also extend from the sole plate 212 to limit movement of the tooth 256A. Once pivoted, the portion of the tooth 256A on the second arm 259B engages the third series of teeth 252B to enable the piston 228 to progress along the third series of teeth 252C.

In still another embodiment, instead of a pivoting tooth, the tooth is non-pivotable, but has two opposing, angled surfaces, one of which engages the first series of teeth when the piston 228 moves forward, and the other of which engages the third series of teeth when the piston 228 moves rearward. No second series of teeth 252B is needed. In such an embodiment, a foot-facing surface of the piston 228 has an extension extending upward, and a portion of the sole plate 212 directly overlays the piston 228 and has a cam surface along which the extension rides as the piston 228 progresses. The cam surface is configured to guide the extension, thereby guiding the tooth of the piston 228 to engage the first series of teeth 252A followed by the third series of teeth 252C.

Figure 10:
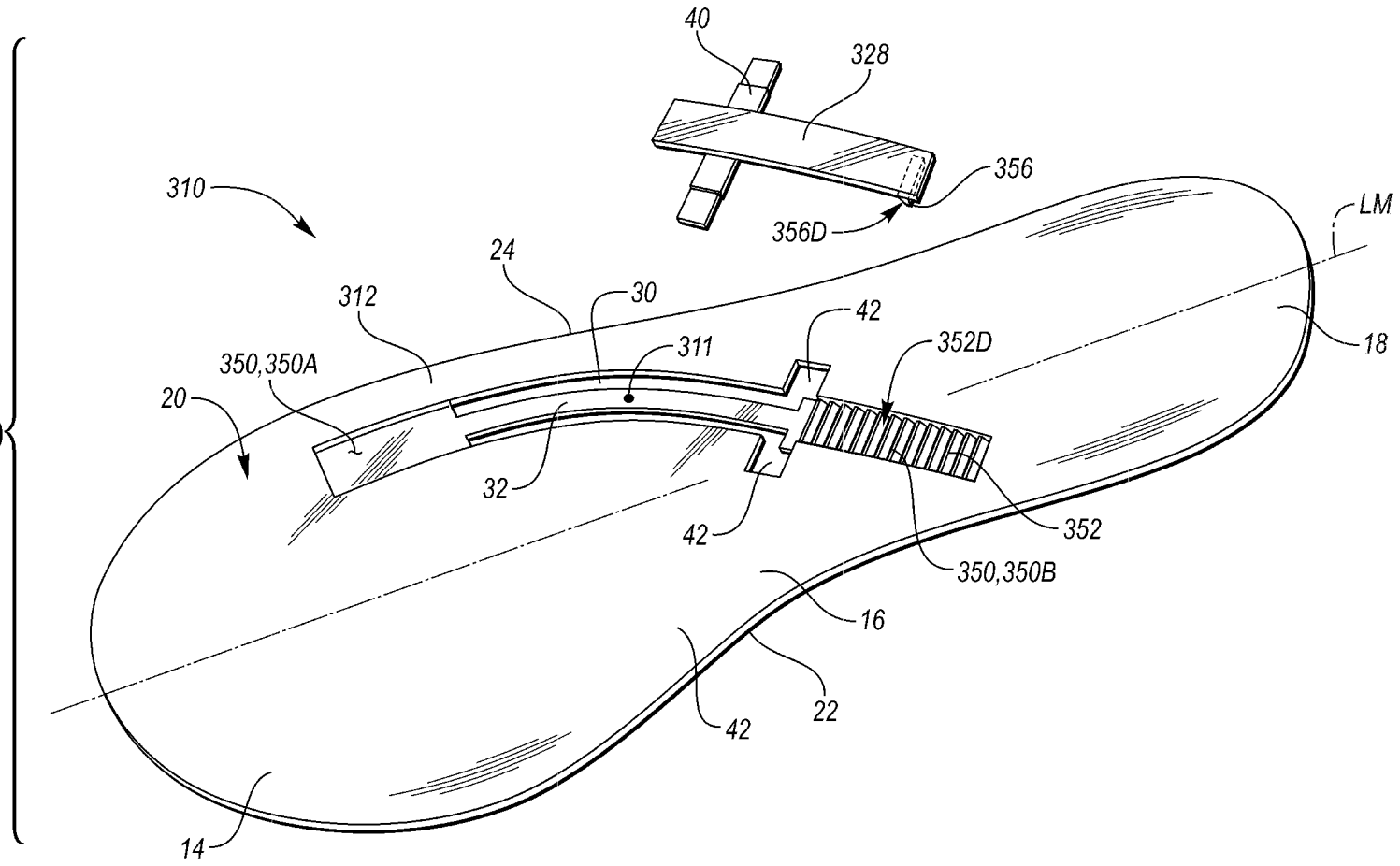
FIG. 10 is a schematic illustration in exploded perspective view of another alternative embodiment of a sole structure showing a foot-facing surface of a sole plate.

FIG. 10 shows another embodiment of a sole structure 310 within the scope of the present teachings. The sole structure 310 is configured with many of the same components that function in the same manner as described with respect to sole structure 10 and are referred to with the same reference numbers. The sole structure 310 has a piston 328, and is configured with a sole plate 312 that has a guide track 350 with a forward section 350A (also referred to as a first section) and a rearward section 350B (also referred to as a second section). The guide track 350 has a series of teeth 352 rearward of the bridge portion 32 and the opening 30. The forward section 350A of the guide track 350 has no teeth.

The piston 328 has only a single tooth 356 with a surface 356D that inclines in a rearward direction from a base to a tip, so that it will interface with the forward-inclining faces 352D of the teeth 352 to ratchet the piston 328 forward with repetitive dorsiflexion of the sole structure 310 as described with respect to the teeth 52, 56 of the sole structure 10 of FIG. 1. The recessed area of the foot-facing surface 20 forming the forward section 350A of the guide track 350 will guide the front of the piston 328. By locating the interfacing teeth 352, 356 only in the rearward section 350B which is generally in the midfoot region 16, movement of the tooth 356 over the tooth 352 is not subject to any interference due to the loading of the weight of the wearer, which is borne by the forefoot region 14 during dorsiflexion.

The guide track 350 initially curves generally toward the lateral side 24 of the sole plate 312 and then extends generally parallel with the longitudinal midline LM. The arm 40 will thus extend under the foot support portion 19 more on the lateral side 24 than on the medial side 22 as the piston 328 progresses forward. Accordingly, bending that may occur along a transverse axis, such as when running around a curve on a running track, will cause more stiffness at the lateral side 24 of the sole plate 312 than the medial side 22 of the sole plate 312. After progressing to approximately point 311 to increase the transverse (lateral) bending stiffness when running along a curved portion of the track, the piston 328 then moves generally parallel to the longitudinal midline LM to correspond with a straight portion of the running track, increasing the longitudinal bending stiffness of the sole structure 310.

Figure 11:
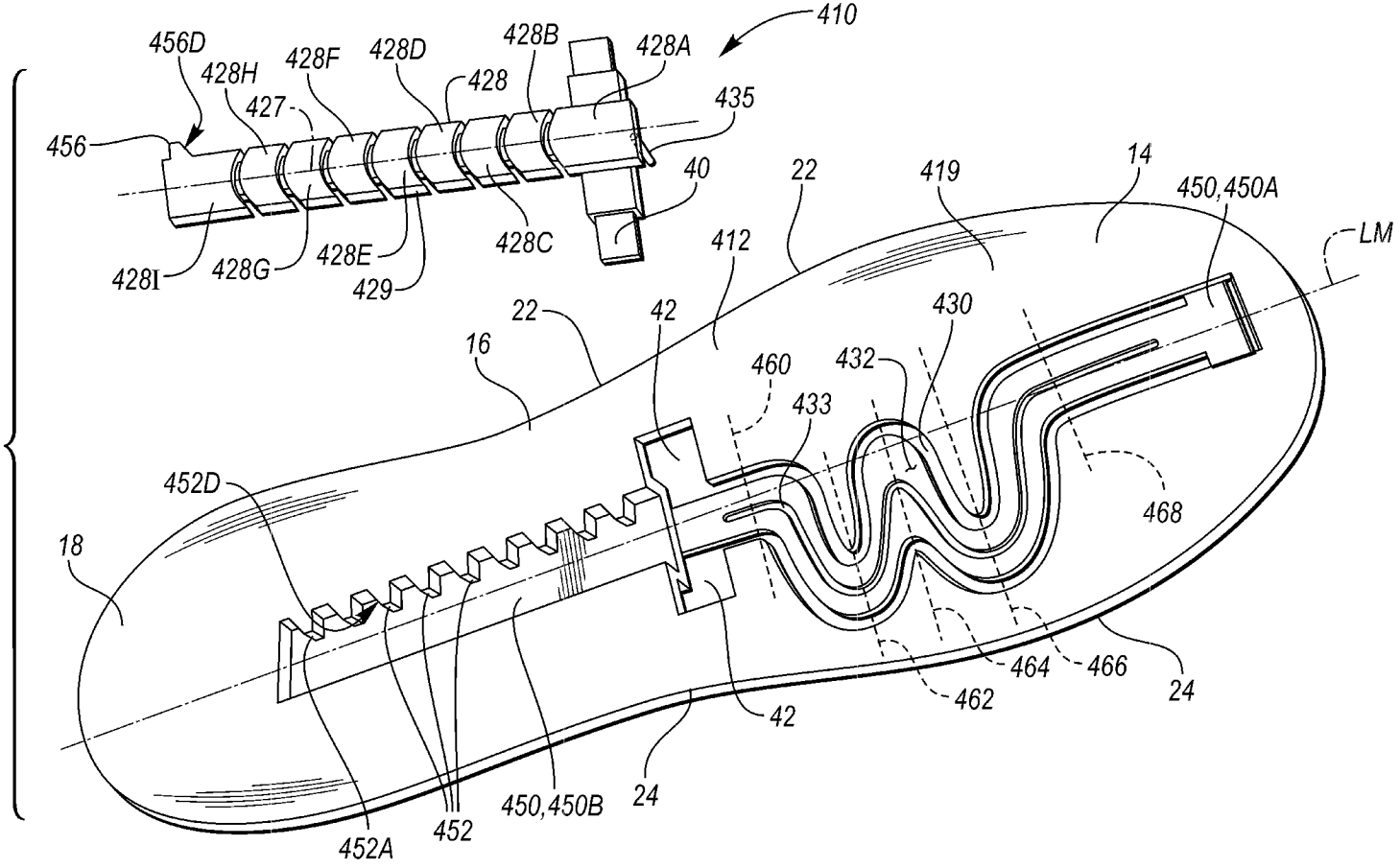
FIG. 11 is a schematic illustration is a schematic illustration in exploded perspective view of another alternative embodiment of a sole structure showing a foot-facing surface of a sole plate.

FIG. 11 shows another embodiment of a sole structure 410 within the scope of the present teachings. The sole structure 410 is configured with many of the same components that function in the same manner as described with respect to sole structure 10 and are referred to with the same reference numbers.

The sole structure 410 has a sole plate 412 that has a guide track 450 with a forward section 450A (also referred to as a first section) and a rearward section 450B (also referred to as a second section). The guide track 450 has a series of teeth 452 rearward of a bridge portion 432 and the opening 430. The forward section 450A of the guide track 450 has no teeth. The teeth 452 of the rearward section 450B extend from a base to a tip transversely relative to the sole plate within the recessed guide track 450, instead of vertically from base to tip as the teeth 52 of FIG. 1.

The sole structure 410 has a piston 428 with a body 429 that is a series of segments 428A, 428B, 428C, 428D, 428E, 428F, 428G, 428H, and 428I, interconnected similarly to links of a chain so that the segments are able to articulate relative to one another. This enables a center longitudinal axis 427 of the piston 428 to change from the straight orientation in FIG. 11 to a curved orientation. The piston 428 has an engagement feature, which is a protrusion in the form of a single tooth 456 that has a surface 456D that extends from a base to a tip transversely relative to the sole plate and in an opposite direction than the teeth 452, and inclines in a rearward direction from a base to a tip. The surface 456D interfaces with the forward-inclining faces 452D of the teeth 452 to ratchet the piston 428 forward with repetitive dorsiflexion of the sole structure 410 as described with respect to the teeth 52, 56 of the sole structure 10 of FIG. 1. The tooth 456 extends from a rearmost one of the segments 428I. In other embodiments, the piston 428 could have multiple teeth that engage with respective one of the teeth 452.

The sole plate 412 has a bridge portion 432 underlying the foot support portion 419 of the sole plate 412, and secured to the foot support portion 419 fore and aft of the opening 430. When the arm 40 of the piston 428 is placed through the notches 42 of the opening 430, the tooth 456 is engaged with a rearmost one 452A of the teeth 452 and the body 429 extends through the opening 430. The support arm 40 is supported on the bridge portion 432 and is trapped below the ground-facing surface of the sole plate 412 by the foot support portion 419, as described with respect to the piston 28 of FIG. 1.

The bridge portion 432 and the opening 430 both curve between the longitudinal midline toward the lateral side 24 of the sole plate 412 twice between the rearward section 450B and the forward section 450A of the guide track 450. The curves of the guide track 450 may be configured to correspond with a desired variation in bending stiffness in dorsiflexion and in transverse stiffness for a race having two curved portions, such as a 400 meter track race on an oval track. Repetitive dorsiflexion of the sole structure 410 will cause the piston 428 to ratchet forward along the teeth 452 of the sole plate 412 in a manner similar to that described with respect to teeth 52 and 56 in FIGS. 6A-6D. Because the piston body 429 is articulated, the orientation of the arm 40 relative to the longitudinal midline LM will vary both in the longitudinal direction and in a transverse direction between the lateral side 24 and the medial side 22 as the piston 428 ratchets forward. For example, the piston 428 will move from a start position with the arm 40 generally below the notches 42 to a position in which the arm 40 corresponds with line 460. The bridge portion 432 may have a recessed groove running generally along its center. The piston 428 may have a post 435 extending downward from the segment 428A and engaged in the groove 433. As the piston body 429 is ratcheted forward by the tooth 456 engaging the teeth 452, the groove 433 guides the piston 428 via the post 435. The bending stiffness increases in the longitudinal direction from the start to the position at line 460 due to the effect of the arm 40 on the bridge portion 432 as described with respect to FIGS. 4B-4C.

Further repetitive dorsiflexion of the sole structure 410 causes the piston 428 to progress forward, with the piston body 429 winding along the guide track 450 until the arm 40 is at the position corresponding with line 462. At this position, the arm 40 will extend under the foot support portion 419 more on the lateral side 24 than on the medial side 22. Accordingly, bending that may occur along a transverse axis, such as when running around a curve on a curved track, will cause more stiffness at the lateral side 24 of the sole plate 412 than the medial side 22 of the sole plate 412.

Further repetitive dorsiflexion of the sole structure 410 causes the piston 428 to progress forward, with the piston body 429 winding along the guide track 450 until the arm 40 is at the position corresponding with line 464. At this position, the arm 40 will extend under the foot support portion 419 generally evenly on either side of the longitudinal midline LM. Bending stiffness with dorsiflexion will increase relative to the position at line 462, and stiffness in bending along a transverse axis will decrease. The position at line 464 may best correlate with running along a straight-away following a curve.

Further repetitive dorsiflexion of the sole structure 410 causes the piston 428 to progress forward, with the piston body 429 winding along the guide track 450 until the arm 40 is at the position corresponding with line 466. At this position, the arm 40 will extend under the foot support portion 419 more on the lateral side 24 than on the medial side 22. Accordingly, bending that may occur along a transverse axis, such as when running around a curve on a curved track, will cause more stiffness at the lateral side 24 of the sole plate 412 than the medial side 22 of the sole plate 412.

Further repetitive dorsiflexion of the sole structure 410 causes the piston 428 to progress forward, with the tooth 456 engaging with the teeth 452 of the guide track 450 to incrementally ratchet the piston 428 forward, with the piston body 429 winding along the guide track 450 until the arm 40 is at the position corresponding with line 468. At this position, the arm 40 will extend under the foot support portion 419 generally evenly on either side of the longitudinal midline LM. Bending stiffness with dorsiflexion will increase relative to the position at line 466, and stiffness in bending along a transverse axis will decrease. The position at line 468 may best correlate with running along a straight-away following a curve, and when relatively high bending stiffness with dorsiflexion is desired. For example, the position at line 468 may correlate with running a straight-away at the end of a 400 meter race.

Figure 12:
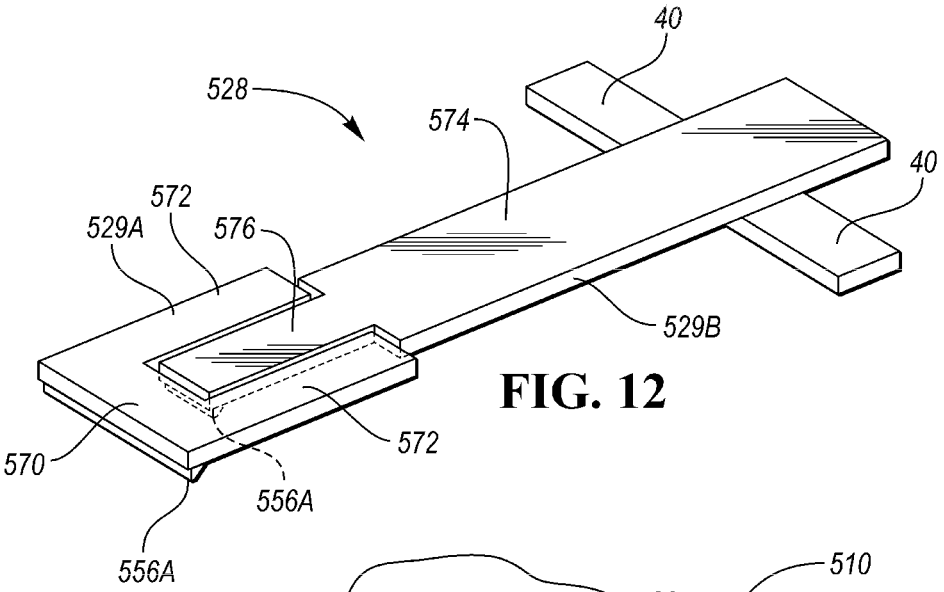
FIG. 12 is a schematic illustration in perspective view of an alternative embodiment of a piston for a sole structure.
Figure 13:
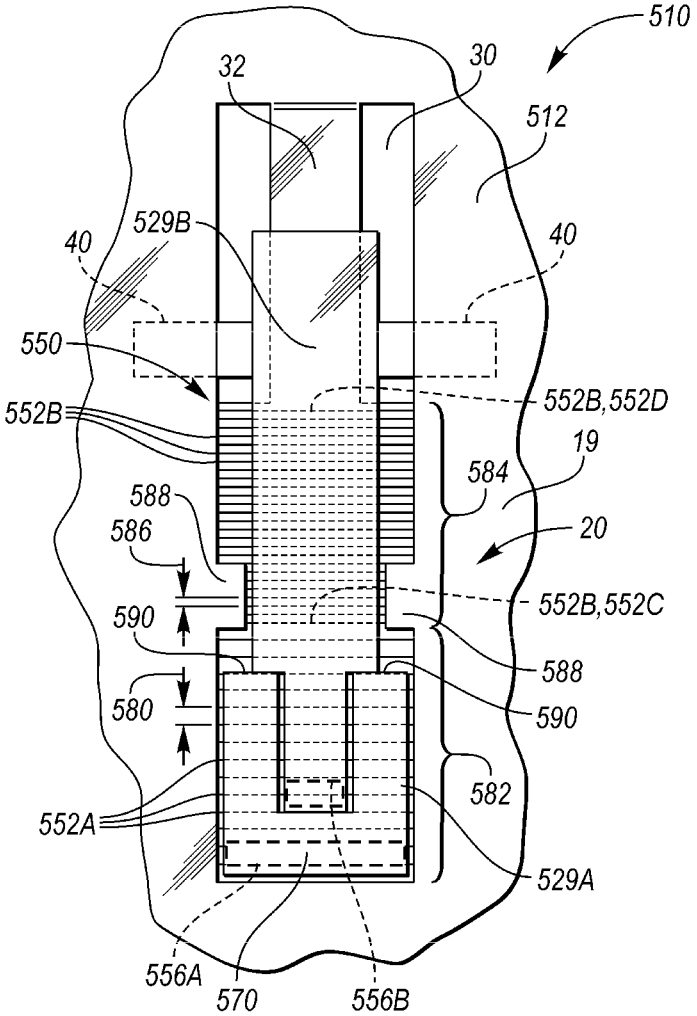
FIG. 13 is a schematic illustration in fragmentary plan view of a sole structure with the piston of FIG. 12.

FIGS. 12 and 13 show a sole structure 510 with an alternative embodiment of a piston 528, a sole plate 512, and a guide track 550. The guide track 550 has teeth with a varied spacing. A first series of teeth 552A at a first portion 582 of the guide track 550 have a relatively large first spacing 580. A second series of teeth 552B at a second portion 584 of the guide track are in line with the first series of teeth 552A and have a second, relatively small spacing 586 (i.e., smaller than the first spacing 580). The spacing of the teeth is the distance along the guide track in the forward direction between tips of an adjacent pair of teeth. In the plan view of FIG. 13, the tips appear as lines. Only some of the teeth 552A, 552B are indicated with reference lines in FIG. 13.

The piston 528 includes a piston body 529A, 529B and the arm 40. The piston body 529A, 529B includes a rear car 529A and a front car 529B. The rear car 529A has an engagement feature that is a tooth 556A which extends downward at a rear of the rear car 529A. The tooth 556A is configured to engage with the first series of teeth 552A. The front car 529B has an engagement feature that is a tooth 556B which extends downward at a rear of the front car 529B. The tooth 556B is configured to engage with the second series of teeth 552B. The sole plate 512 has an obstruction 588 that narrows the guide track 550 at a transition from the first series of teeth 552A to the second series of teeth 552B. The obstruction 588 is a pair of transversely-extending arms that extend at the foot-facing surface 20 above the recessed teeth 552A, 552B. The obstruction 588 blocks ratcheting of the rear car 529A along the guide track 550 at a predetermined position between a start position and a final position of the piston body.

The rear car 529A abuts the front car 529B between the start position (i.e., the position shown in FIG. 13) and a predetermined position such that the front car 529B is moved by the rear car 529A as the tooth 556A of the rear car 529A engages with the first series of teeth 552A and is ratcheted along the guide track from the start position to the predetermined position with repetitive dorsiflexion of the sole structure 510. The predetermined position is the position of the rear car 529A when the forward ends 590 of the arms 572 abut the obstruction 588. During this span of ratcheting, the tooth 556B is too small to engage with the teeth 552A due to the larger spacing 580 and the greater depth of the teeth 552A, so it simply sets between adjacent teeth 552A without necessarily contacting the teeth 552A.

The rear car 529A is generally U-shaped, with a back 570 and with two arms 572 that extend forward from the back 570. The front car 529B has an elongated rectangular forward portion 574 with a neck 576 extending rearward from the forward portion 574. The neck 576 fits between the two arms 572. The entire front car 529B is narrower than the span between the obstructions 588.

During ratcheting, the rear car 529A abuts the front car 529B at a rear of the neck 576 and at a rear of the forward portion 574. The front car 529B is moved by the rear car 529A by this abutment as the rear car 529A is ratcheted along the guide track 550 from the start position to the predetermined position. When the obstruction 588 prevents further forward ratcheting of the rear car 529A, the front car 529B has been moved to a position in which the tooth 556B is engaged with a rearmost one 552C of the teeth 552B. Further repetitive dorsiflexion of the sole structure 510 will thus cause the tooth 556B of the front car 529B to ratchet the front car 529B along the second portion 584 of the guide track 550, free of the obstruction 588. The front car 529B will be ratcheted forward in this manner from the predetermined position to a final position in which the tooth 556B is engaged with a forward-most tooth 552D of the teeth 552B.

Because the teeth 552B have closer spacing that the teeth 552A, the arm 40 will move forward in a direction along the longitudinal axis LM of the sole plate 512 a smaller distance per step between the predetermined position and the final position than the distance per step from the start position to the predetermined position. The larger spacing of teeth 552A may correspond with an expected relatively large flex angle, such as at the start of a race, and the smaller spacing of the teeth 552B may correspond with an expected relatively low flex angle, such as shortly after the start. Stiffness of the sole structure 510 is dependent upon the longitudinal position of the arm 40 between the bridge portion 32 and the foot supporting portion, as explained herein. Stiffness will thus vary at larger rate when the rear car 529A is moving forward than when only the front car 529B is moving forward. In other embodiments, the rear car 529A could be any suitable shape to push the front car 529B. For example, both the rear car and the front car could be rectangular, with the forward edge of the rear car abutting the rear edge of the front car.

Figure 14:
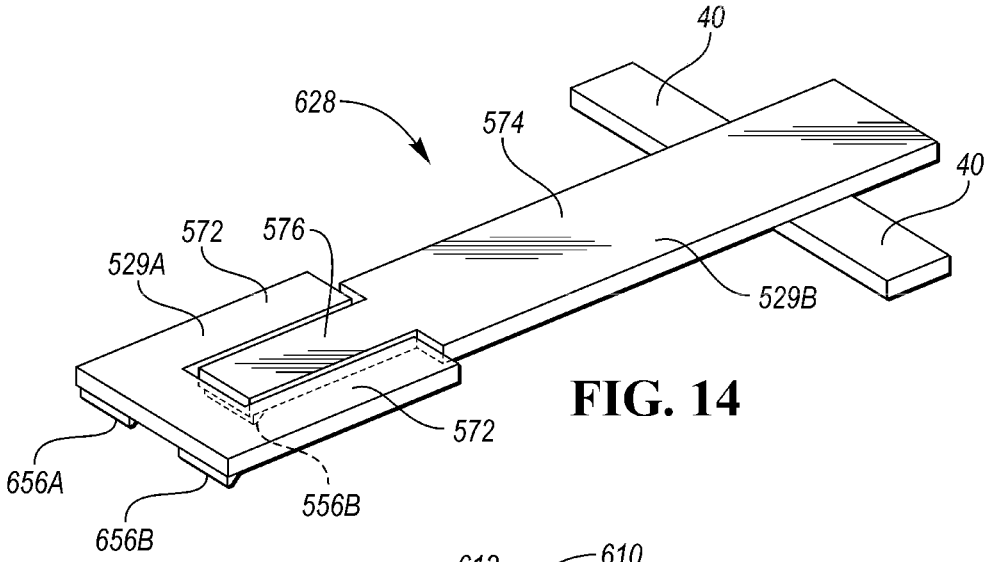
FIG. 14 is a schematic illustration in perspective view of another alternative embodiment of a piston for a sole structure.
Figure 15:
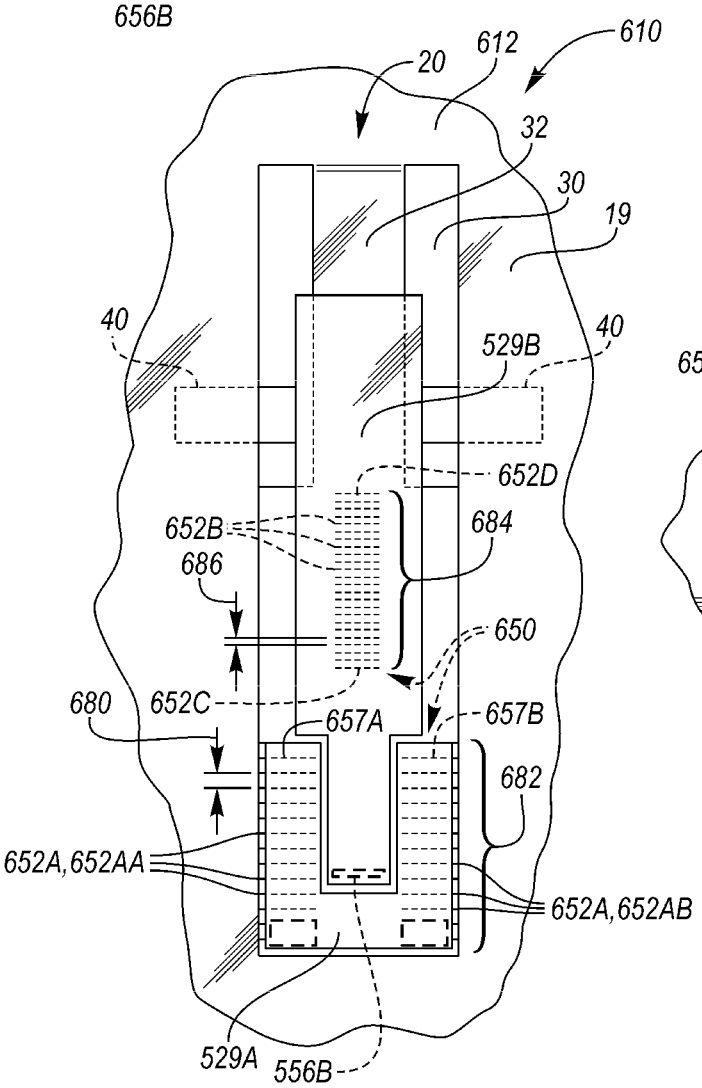
FIG. 15 is a schematic illustration in fragmentary plan view of an alternative embodiment of a sole structure with the piston of FIG. 14 and a sole plate.
Figure 16:
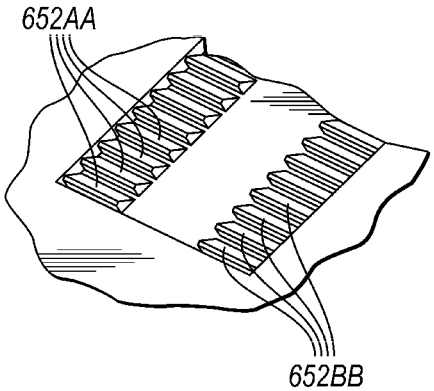
FIG. 16 is a schematic illustration in fragmentary perspective view of the sole plate of FIG. 15.

FIGS. 14-16 show another embodiment of a sole structure 610 with an alternative embodiment of a piston 628, a sole plate 612, and a guide track 650. The guide track 650 has teeth with a varied spacing. A first series of teeth 652A at a first portion 682 of the guide track 650 have a relatively large first spacing 680. The first series of teeth 652A are split into two transversely spaced sets 652AA, 652AB, as best shown in FIG. 16. A second series of teeth 652B at a second portion 684 of the guide track are forward of but transversely between the split first series of teeth 552A and have a second, relatively small spacing 686 (i.e., smaller than the first spacing 580). Only some of the teeth 652A, 652B are indicated with reference lines in FIG. 15.

In this embodiment, no obstruction is required to stop ratcheting of the rear car 529A. Because the teeth 656B are not in line with the teeth 656A, the rear car 529A stops moving forward at the forward-most tooth 656A, unlike in FIG. 13 where further dorsiflexion could cause the rear car 529A to ratchet along the front teeth 556B if the obstruction 588 was not present.

The piston 628 is alike in all aspects as piston 528, except that the tooth 556A is replaced with a split tooth (i.e., two transversely-spaced teeth) 656A, 656B. Otherwise, like reference numbers are used to reference the features of piston 628 as shown and described with respect to piston 528.

The rear car 529A abuts the front car 529B between the start position (i.e., the position shown in FIG. 15) and a predetermined position such that the front car 529B is moved by the rear car 529A as the split tooth 656A, 656B engages with the two transversely spaced sets 652AA, 652AB. respectively, and is ratcheted along the guide track 650 from the start position to the predetermined position with repetitive dorsiflexion of the sole structure 610. The predetermined position is the position of the rear car 529A when the split tooth 656A, 656B is engaged with a forward-most one 657A, 657B of the teeth of the sets 652AA, 652BB. During this span of ratcheting, the tooth 556B has no teeth to engage, and, because it does not extend downward as far as teeth 656A, 656B, it is simply carried along with the front car 529B above the surface of the guide track 650 during ratcheting of the rear car 529A during repetitive dorsiflexion.

When the split tooth 656A, 656B is engaged with teeth 657A, 657B, the front car 529B has been moved sufficiently forward that the tooth 556B is engaged with a rearmost tooth 652C of the second series of teeth 652B. Further repetitive dorsiflexion of the sole structure 610 will thus cause the tooth 556B of the front car 529B to ratchet the front car 529B along the second portion 684 of the guide track 650. The front car 529B will be ratcheted forward in this manner from the predetermined position to a final position in which the tooth 556B is engaged with a forward-most tooth 652D of the teeth 652B.

Because the teeth 652B have closer spacing that the teeth 652A, the arm 40 will move forward in a direction along the longitudinal axis LM of the sole plate 12 at a smaller distance per step between the predetermined position and the final position than the distance per step from the start position to the predetermined position. Stiffness of the sole structure 610 is dependent upon the longitudinal position of the arm 40 between the bridge portion 32 and the foot support portion 19, as explained herein. Stiffness will thus vary at larger rate when the rear car 529A is moving forward than when only the front car 529B is moving forward.

While several modes for carrying out the many aspects of the present teachings have been described in detail, those familiar with the art to which these teachings relate will recognize various alternative aspects for practicing the present teachings that are within the scope of the appended claims. It is intended that all matter contained in the above description or shown in the accompanying drawings shall be interpreted as illustrative only and not as limiting.

The invention claimed is:

1. A method of manufacturing a sole plate for an article of footwear, the method comprising:

configuring the sole plate with a guide track having protrusions and with a piston configured to move relative to the sole plate incrementally along the protrusions in response to repetitive dorsiflexion of the sole plate to vary a bending stiffness of the sole plate in accordance with an expected number of steps to be taken by a wearer of the sole plate in a predetermined event.

2. The method of claim 1, wherein the guide track and the protrusions are configured so that the bending stiffness of the sole plate varies in both a longitudinal direction of the sole plate and a transverse direction of the sole plate.

3. The method of claim 2, wherein the guide track and the protrusions are configured to progressively increase and decrease the bending stiffness of the sole plate in the longitudinal and transverse directions multiple times over a course of progression of the piston along the protrusions.

4. The method of claim 1, wherein the expected number of steps is based on an average number of steps of a population of wearers of the sole plate in the predetermined event.

5. The method of claim 1, wherein the expected number of steps is based on a particular wearer of the sole plate in the predetermined event.

6. The method of claim 1, wherein:

the predetermined event occurs on a track or a course having a portion with a predetermined characteristic;

the expected number of steps includes a range of steps occurring along the portion with the predetermined characteristic; and the guide track and the protrusions are configured so that movement of the piston relative to the sole plate during the range of steps occurring along the portion with the predetermined characteristic varies the bending stiffness of the sole plate in correspondence with the predetermined characteristic.

7. The method of claim 6, wherein:

the sole plate is configured for a right foot;

the predetermined event is on a running track;

the predetermined characteristic is a curve of the running track; and the piston moves toward a lateral side of the sole plate during the range of steps occurring along the curve to increase the bending stiffness in a transverse direction of the sole plate.

8. The method of claim 7, wherein:

the range of steps is a first range of steps, and the running track further includes a straightaway; and the guide track and the protrusions are configured so that movement of the piston relative to the sole plate during a second range of steps occurring along the straightaway decreases the bending stiffness of the sole plate in the transverse direction relative to the first range of steps occurring along the curve.

9. The method of manufacturing of claim 8, wherein:

the curve is a first curve, the straightaway is traversed by the second range of steps following traversal of the first curve by the first range of steps, the running track further includes a second curve, and the guide track and the protrusions are configured so that movement of the piston relative to the sole plate during a third range of steps occurring along the second curve increases the bending stiffness of the sole plate in the transverse direction relative to the straightaway.

10. The method of manufacturing of claim 9, wherein:

the straightaway is a first straightaway, the running track further includes a second straightaway, and the guide track and the protrusions are configured so that movement of the piston relative to the sole plate during a fourth range of steps occurring along the second straightaway decreases the bending stiffness of the sole plate in the transverse direction relative to the second curve.

11. The method of claim 1, wherein the protrusions are configured in correspondence with an expected distance per step.

12. The method of claim 1, further comprising:

varying a spacing of the protrusions in correspondence with different portions of the predetermined event.

13. The method of claim 12, wherein:

the protrusions include a first series of teeth and a second series of teeth configured so that the piston moves along the second series of teeth after the first series of teeth; and a spacing between teeth of the first series is larger than a spacing between teeth of the second series and corresponds with an expected relatively large flex angle of the sole plate at a start of the predetermined event followed by a relatively small flex angle of the sole plate, the bending stiffness of the sole plate varying at a greater rate when the piston moves along the first series of teeth than when the piston moves along the second series of teeth.

14. The method of claim 1, further comprising:

configuring the sole plate with a foot-facing surface and a ground-facing surface, a compressive portion above a neutral axis; a tensile portion below the neutral axis; and the guide track in the foot-facing surface; and configuring the piston with a body disposed above the tensile portion, with a support arm extending from the body and that rests on the tensile portion and is disposed below the compressive portion and against the ground-facing surface, and with at least one protrusion engaged with the protrusions of the guide track and ratcheting the piston along the guide track as the piston moves relative to the sole plate in response to dorsiflexion of the sole structure.

15. The method of claim 14, wherein the sole plate has an opening, the body of the piston extends through the opening, and the support arm extends across the opening.

16. The method of claim 1, wherein configuring the sole plate with a guide track having protrusions includes:

arranging a first set of directional fibers on the guide track; and arranging a second set of directional fibers on the piston, the second set of directional fibers configured to engage the first set of directional fibers.

17. The method of claim 16, wherein arranging the first set of directional fibers on the guide track includes arranging the fibers as parallel rows of individual fibers laid transverse to a longitudinal midline of the sole plate.

18. The method of claim 16, wherein:

arranging the first set of directional fibers on the guide track includes adhering a backing of the first set of directional fibers to the sole plate; and arranging the second set of directional fibers on the piston includes adhering a backing of the second set of directional fibers on the piston.

19. The method of claim 1, further comprising:

determining the expected number of steps.

* * * * *